US006787742B2

(12) United States Patent
Kansa et al.

(10) Patent No.: US 6,787,742 B2
(45) Date of Patent: Sep. 7, 2004

(54) HIGH-FREQUENCY INDUCTION HEATING DEVICE

(75) Inventors: Ken Kansa, 2-18-8 Showa, Kawasaki-ku, Kawasaki-shi, Kanagawa (JP); Yoshihide Mukouyama, Tokyo (JP); Masatoshi Matsuba, Tokyo (JP)

(73) Assignee: Ken Kansa, Kanagawa (JP)

( * ) Notice: Subject to any disclaimer, the term of this patent is extended or adjusted under 35 U.S.C. 154(b) by 67 days.

(21) Appl. No.: 10/198,050

(22) Filed: Jul. 19, 2002

(65) Prior Publication Data

US 2003/0066829 A1 Apr. 10, 2003

(30) Foreign Application Priority Data

Jul. 23, 2001 (JP) ..... 2001-222009
Jul. 23, 2001 (JP) ..... 2001-222010
May 10, 2002 (JP) ..... 2002-135755

(51) Int. Cl.[7] ..... H05B 6/10; C10J 3/68

(52) U.S. Cl. ..... 219/628; 219/629; 219/635; 219/651; 373/141; 75/10.14

(58) Field of Search ..... 219/628, 629, 219/630, 635, 647, 649, 651; 373/141; 75/10.14

(56) References Cited

U.S. PATENT DOCUMENTS 5,324,904 A * 6/1994 Cresswell et al. ..... 219/635
6,478,839 B1 * 11/2002 Kansa et al. ..... 75/10.14
2003/0079411 A1 * 5/2003 Kansa et al. ..... 48/77

FOREIGN PATENT DOCUMENTS

JP 07-012321 * 1/1995
JP 11-226542 * 8/1999

* cited by examiner

*Primary Examiner*—Philip H. Leung
(74) *Attorney, Agent, or Firm*—Sughrue Mion, PLLC

(57) ABSTRACT

A high-frequency induction-heating device preferably comprises an introduction part which introduces a gas to be treated; a pyrolysis part which pyrolyzes the gas to be treated; an induction heating coil provided around the outer circumference of the pyrolysis part so as to surround and heat the pyrolysis part, and an exhaust part which exhausts the gas having been decomposed in the pyrolysis part; wherein the pyrolysis part comprises a cylindrical body both ends of which are sealed, slits which communicate the interior with the exterior of the cylindrical body provided on the outer surface of the cylindrical body, and a communication pores to be communicated with an introduction tube which introduces the gas to be treated into the interior of the cylindrical body.

10 Claims, 21 Drawing Sheets

HIGH-FREQUENCY INDUCTION HEATING DEVICE

BACKGROUND OF THE INVENTION

1. Field of the Invention

This invention concerns a high-frequency induction heating device and a device and method for using the high-frequency induction heating device to pyrolyze organic compounds. Specifically, this invention belongs to an art by which substances containing harmful compounds such as organohalogen compounds and other hazardous substance are decomposed in a gas phase by high-frequency induction heating.

2. Description of Related Arts

Organohalogen compounds, which contain chlorine, bromine, or other halogens, include many compounds that are designated as specified chemical substances or designated chemicals and also include many compounds that are causative agents of environmental problems. Representative examples include halogen-substituted aromatic organic compounds, such as dioxins, polychlorinated biphenyls, chlorobenzene, etc., and aliphatic organohalogen compounds, such as tetrachloroethylene, trichloroethylene, dichloromethane, carbon tetrachloride, 1,2-dichloroethylene, 1,1-dichloroethylene, cis-1,2-dichloroethylene, 1,1,1-trichloroethane, 1,1,2-trichloroethane, 1,3-dichloro-propene, etc.

These organohalogen compounds exist in various forms, i.e., solid, liquid, and gas forms.

For example, polychlorinated biphenyls (hereinafter referred to as "PCBs"), due to being highly resistant and chemically stable against acids and bases, extremely stable thermally, excellent in electric insulating properties, wide in the form of existence from liquid to solid, etc., have been used widely and in large amounts in numerous applications as insulating oils for transformers, capacitors, etc., plasticizers for electric cables, etc., and thermal media for a variety of processes in various chemical industries.

However, it has been found that hazardous substances are generated and environmental pollution is caused when PCBs and substances containing PCBs are combusted and that hazardous substances, originating from PCB's, become accumulated in human bodies by biological concentration through the food chain, especially through fishes, shellfishes, and other marine products. The production of PCBs was thus prohibited in 1972. Though problems of direct pollution due to the manufacture, etc. of PCBs were thus avoided, since PCBs have been used in a wide variety of uses due to their high degree of general usability and are difficult to decompose, the treatment and disposal of PCBs and substances containing PCBs have now become new environmental problems.

That is, if ordinary incineration treatment is performed to treat and dispose of PCBs and substances containing PCBs, dioxin and other hazardous substances are generated due to the low incineration temperature and these hazardous substances become discharged into the atmosphere along with flue gas, thereby causing further air pollution. On the other hand, if landfill disposal is performed, since PCBs have the properties of being excellent in stability and extremely difficult to decompose, the PCBs become eluted into the soil to give rise to soil, river, and marine pollution.

PCBs and products containing PCBs therefore could not be treated or disposed readily and the actual circumstances are such that PCBs and/or substances containing PCBs are simply stored upon being recovered by municipalities, etc.

Under such circumstances, various methods of treating PCBs are being examined. Representative decomposition treatment methods include high temperature incineration treatment methods, decomposition by enzymes and bacteria, treatment by chemicals (alkaline decomposition methods), etc., and among these, high-temperature incineration methods, with which PCBs are subject to incineration treatment at high temperature, were the most effective methods.

However, even with high-temperature incineration methods, there were problems that required improvement, such as the degradation of the furnace by the chlorine that is generated when PCBs are decomposed, the difficulty of furnace body management due to the requirement of high temperature (for example, 1600° C. or more) for treatment, the containing of large amounts of undecomposed PCBs in the incineration residue in some cases due to the incineration heat not being transmitted completely to the treated object, the generation of coplanar PCBs, dioxin, and other new hazardous substances in some cases by low temperature incineration caused by the inability to perform swift temperature control upon lowering of the incineration temperature due to poor control response to incineration temperature, etc.

Also, in the case of treatment of PCBs contained inside a container, such as in the case of a transformer, capacitor, etc., the PCBs could not be treated unless the PCBs were taken out of the transformer, capacitor, etc., and there were problems of contamination of workers during the work of taking out the PCBs and problems of treatment of PCBs remaining inside a transformer or capacitor after taking out the PCBs.

Also, a high-temperature incineration furnace is an extremely expensive device and a vast amount of space is required for the installation of a high-temperature incineration furnace. A high-temperature incineration furnace is also a device that takes an extremely large amount of time for the interior of the furnace to reach a desired temperature (that is, slow in startup) and takes an extremely large amount of time for the internal temperature to drop to ordinary temperature after heating has been stopped.

Thus in the case where organohalogen compounds are to be decomposed using a high-temperature incineration furnace, a large amount of the treated object had to be treated in a batch and the treatment of organohalogen compounds in a small-scale facility accompanied extreme difficulties. There were thus demands for a decomposition device and a decomposition method for organohalogen compounds with which heating to a predetermined temperature could be accomplished within an extremely short amount of time and which are compatible with equipment from comparatively small-scale equipment to large-scale equipment.

Also, these organohalogen compounds are contained in solids, liquids, and gases, and there were thus demands for a method of decomposing these organic compounds safely and without fail by practically the same operation method.

Furthermore, various organic compounds besides organohalogen compounds are causative agents of environmental pollution. There were thus demands for a pyrolysis device and pyrolysis method by which decomposition treatment of solids, liquids, and gases containing, for example, malodorous substances, such as indole, skatole, captans, etc., various environmental hormones, formaldehyde and other causative agents of sick house syndrome, waste oil, waste molasses, etc., can be carried out in a unified manner.

That is, there were strong demands for an organic compound pyrolysis device and pyrolysis method by which objects to be treated that contain organic compounds can be pyrolyzed and rendered harmless with a single device, regardless of the form (gas, liquid, or solid) of the organic compounds to be treated and the treated objects containing these organic compounds.

SUMMARY OF THE INVENTION

This invention provides a high frequency induction heating device suitable for use in a device for decomposing an organic compound, which heats and decomposes organic compounds in at least one pyrolysis zone each comprising at least one high-frequency induction heating device.

By the use of a high-frequency induction heating device, the degree of freedom of design of the pyrolysis zone is increased. In particular, the high-frequency induction heating device used in this invention can heat to a predetermined temperature, such as 1600° C., in an extremely short period, such as in 1 second or less, and moreover, enables the heating zone itself to be provided within a small space.

With this invention, by providing a means for gasifying solids and/or liquids at a stage upstream the heating zone, organohalogen compounds contained in the solids and/or liquids can be subject to pyrolysis treatment.

Thus a specific embodiment of this invention may have an arrangement with a gasifying device, for gasification of liquids or solids containing organic compounds, provided at a stage upstream the pyrolysis zone.

Such an arrangement enables decomposition treatment of organic compounds contained in gases, liquids, and solids to be performed with a single device. That is, treatment of organic compounds contained in a gas can be performed by the bypassing of the above mentioned gasifying device.

Also in the case where the organic compounds to be treated are organohalogen compounds that are comparatively difficult to decompose (for example, PCBs), this invention's device may be provided with two or more pyrolysis zones.

In this case, a preheating zone may be provided at a stage upstream a pyrolysis zone, which comprises this invention's high-frequency induction heating device. Additionally or alternatively, a pyrolysis zone, which makes use of radiant heat or comprises another high-frequency induction heating device, may be provided at a stage downstream the pyrolysis zone comprising this invention's high-frequency induction heating device. Also, it is also possible to provide a plurality of high-frequency induction heating devices within one pyrolysis zone According to specific embodiments of the present invention, there provide the following novel high-frequency induction heating devices.

1. A high-frequency induction heating device comprising:

an introduction part which introduces a gas to be treated, a pyrolysis part which pyrolyzes the gas to be treated, an induction heating coil provided around the outer circumference of said pyrolysis part so as to surround and heat said pyrolysis part, and an exhaust part which exhausts the gas having been decomposed in said pyrolysis part;

said pyrolysis part comprising a cylindrical body both ends of which are sealed, slits which communicate the interior with the exterior of said cylindrical body provided on the outer surface of said cylindrical body, and a communication pores to be communicated with an introduction tube which introduces said gas to be treated into the interior of said cylindrical body.

2. A high-frequency induction heating device comprising:

an introduction part which introduces a gas to be treated, a pyrolysis part which pyrolyzes the gas to be treated, an induction heating coil provided around the outer circumference of said pyrolysis part so as to surround and heat said pyrolysis part, and an exhaust part which exhausts the gas having been decomposed in said pyrolysis part;

said pyrolysis part comprising a cylindrical body which introduces the gas provided so that the cross-section of the passage of said cylindrical body becomes smaller from the upstream towards the downstream.

3. The high-frequency induction heating device as set forth in Item 1, wherein said cylindrical body is provided so that the cross-section of the passage of said cylindrical body becomes smaller from the upstream towards the downstream.

4. A high-frequency induction heating device comprising:

an introduction part which introduces a gas to be treated, a pyrolysis part which pyrolyzes the gas to be treated, an induction heating coil provided around the outer circumference of said pyrolysis part so as to surround and heat said pyrolysis part, and an exhaust part which exhausts the gas having been decomposed in said pyrolisis part;

said pyrolysis part having a heating element having a plurality of through holes along the inside of the outer circumference of the diameter direction thereof and ceramic pipes inserted within said plurality of through holes and supported by pipe supporting plates accommodated therein.

5 The high-frequency induction heating device as set forth in Item 4, wherein said pyrolysis part has pressure reducing means for reducing the pressure of the body.

6 The high-frequency induction heating device as set forth in Item 4, wherein said pyrolysis part has compressing means for compressing the body by an inert gas.

7. The high-frequency induction heating device as set forth in Item 4, wherein said pipe supporting plate has a guide member for introducing a gas to be treated into said ceramic pipe.

8. The high-frequency induction heating device as set forth in Item 7, wherein said ceramic pipe is made of at least one member selected from the group consisting of silicon carbide and alumina.

9. The high-frequency induction heating device as set forth in Item 8, wherein step part to be fit to spacers are provided on both ends of said heating element.

10. The high-frequency induction heating device as set forth in Item 9, wherein said spacer comprises non-dielectric material and is formed from a flange having the plurality of through holes and cylindrical body.

DESCRIPTION OF THE PREFERRED EMBODIMENTS

The terminologies used herein have the following meanings.

The term "organic compound" used herein is a compound which has at least one carbon in the structure thereof in the form of a solid, liquid or gas, and which can be gasified at a reaction temperature (e.g., 1000° C. or more). The organic compounds intended herein are so called chemical hazards and include, but are not limited to, aromatic or aliphatic halogen compounds contained, for example, in incinerated ashes, exhaust liquid, and gas, such as PCBs, dioxins; halogen-containing polymers such as PVC, polyvinylidene chloride, polyvinylidene fluoride, specified chemical substances listed in the section of prior art, exhaust oils, exhaust liquid from alcohol distillation, and from squeezing olive oil and other vegetable oils, exhaust syrups, and any other residues from food processing.

The "high-frequency induction heating device" used herein is a heating device that makes use of a high-frequency induced current, in other words, a current that is induced in a conductor by a magnetic field that varies in time.

The techniques (including the device and the method) for pyrolyzing organic compounds using the high-frequency induction heating device according to this invention will now be outlined.

Figure 18:
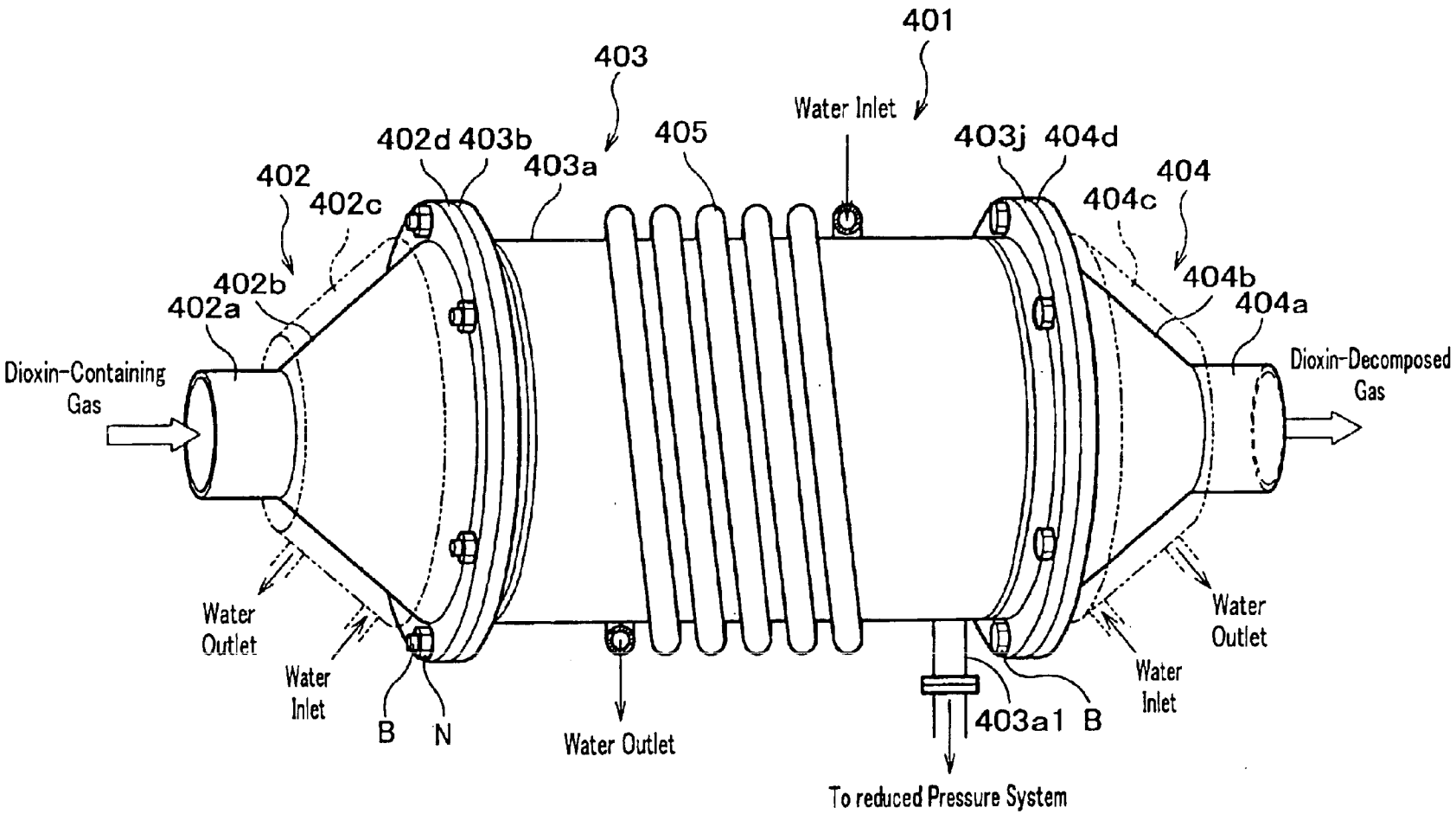
FIG. 18 is a perspective external view of this invention's organohalogen compound pyrolysis device.

The high-frequency induction heating device according to this invention has a construction for example as shown in FIG. 18.

Specifically, the device 401 by this invention comprises an introduction part 402, into which dioxin-containing gas is introduced, a pyrolysis part 403, which pyrolyzes the dioxin-containing gas that has been introduced into the above mentioned introduction part 402, a discharge part 404, which discharges the pyrolysis gas resulting from the decomposition at the above mentioned pyrolysis part 403, and an induction heating coil 405, which surrounds the main body 403*a* of the above mentioned pyrolysis part 403 from the exterior and heats a heating unit 403*f* in the interior, as the principal components.

Introduction part 402 comprises a dioxin-containing gas introduction entrance 402*a* and a duct 402*b*, which becomes enlarged in diameter from the upstream side to the downstream side, as the principal components.

A water-cooled type cooling jacket 402*c* for cooling introduction part 402 is provided at the outer circumference of duct 402*b*.

Such a device is well-known in the art, but there is no example that such a device is used for pyrolyzing an organic compound from the view of energy such as electric power.

However, according to our studies, it has been discovered that when the high-frequency induction heating device is used, a time required for heating-up to a given temperature (i.e., start-up time) and a shut down time to stop the operation are very fast in comparison with the conventional devices for pyrolyzing organic compounds, and the device itself can be designed to be very small. Since it takes very short period of start-up time and/or shut-down time, the high-frequency induction heating device is not required to perform a continuous operation as in the conventional furnace. For this reason, the techniques for pyrolyzing organic compounds can be introduced into a relatively small-scale customer, which has entrusted a specialist with the treatment. Also, while the treatment has been conventionally performed when a prescribed amount of organic substances to be treated are accumulated, the introduction of the present techniques by the high frequency induction heating device makes it possible to treat the substance little by little. Particularly, upon using the high frequency induction heating device described in the following embodiment, the treatment efficiency is sharply increased.

Figure 1A:
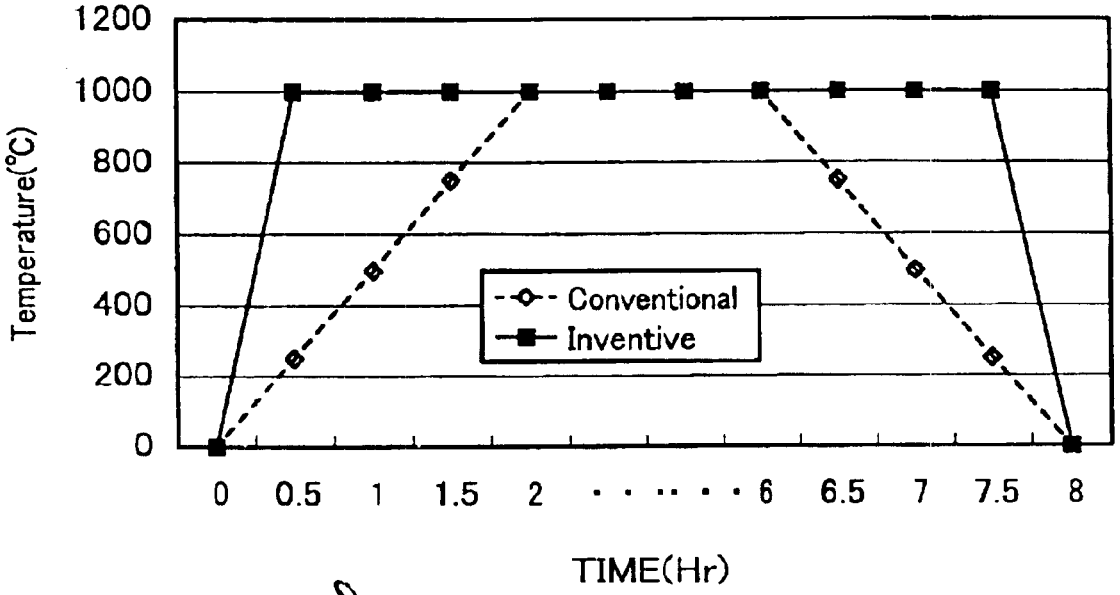
FIG. 1A is a graph showing the relation between the temperature and time when the inventive and prior art devices are operated for 8 hours.
Figure 1B:
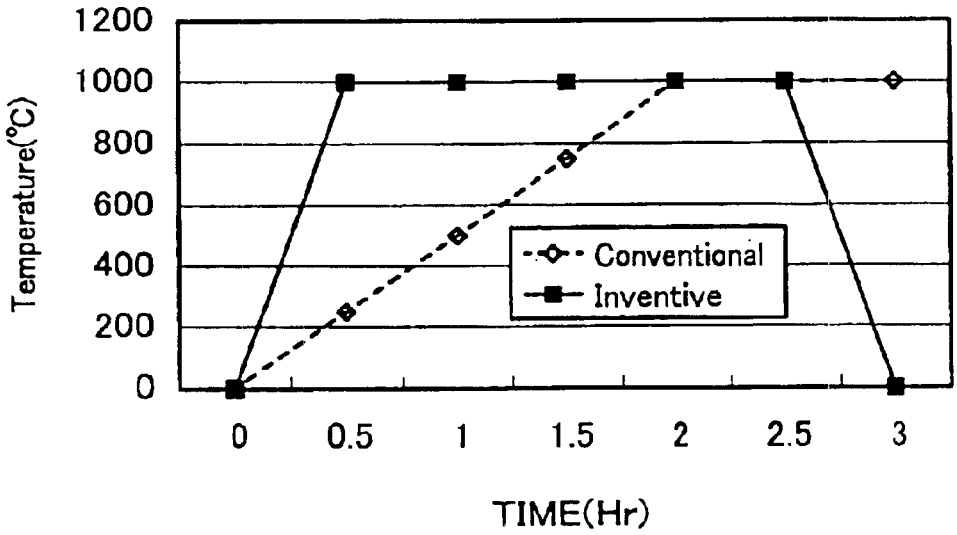
FIG. 1B is a graph showing the relation between the temperature and time when the inventive and prior art devices are operated for 3 hours.

For example, this is explained by referring to FIG. 1A and FIG. 1B each showing the relation between the temperature and the time. FIG. 1A is a graph showing the relation between the temperature and time when the inventive and prior art devices are operated for 8 hours, and FIG. 1B is a graph showing the relation between the temperature and time when the inventive and prior art devices are operated for 3 hours.

As shown in FIG. 1A, in the conventional device, for example, 3 hours is required for preheating. In contrast, in the case of the high frequency induction heating device according to the present invention, only half hour is required to be heated to a prescribed temperature. Similarly, in the prior art, approximately 2 hors have been required for cooling down the device after the operation has been stopped, while the present device only requires 0.5 hours. For this reason, assuming that the treatment is carried out for the same period in each of the prior art device and the present device, practical treatment over a period of 7 hours can be done in the present device, whereas only 4 hours' treatment can be done in the prior art device. Furthermore, as shown in FIG. 1B, concerning 3 hour's total operation, the treatment can be done for 2 hours using the present device, while it is impossible to make any treatment using the prior art device.

In addition, as can been seen in FIG. 1, since the high frequency induction heating device according to the present invention has a good temperature following-up property, the treatment can be effectively done for example at 1600° C., after treatment, for example, at 1000° C. or vice versa.

Consequently, the use of the present device, i.e., the high frequency induction heating device, makes it possible to drastically increase the degree of freedom with regard to the operation schedule.

Moreover, the operation and the maintenance of the prior art device require skill, but those of the present invention are easy.

Figure 2:
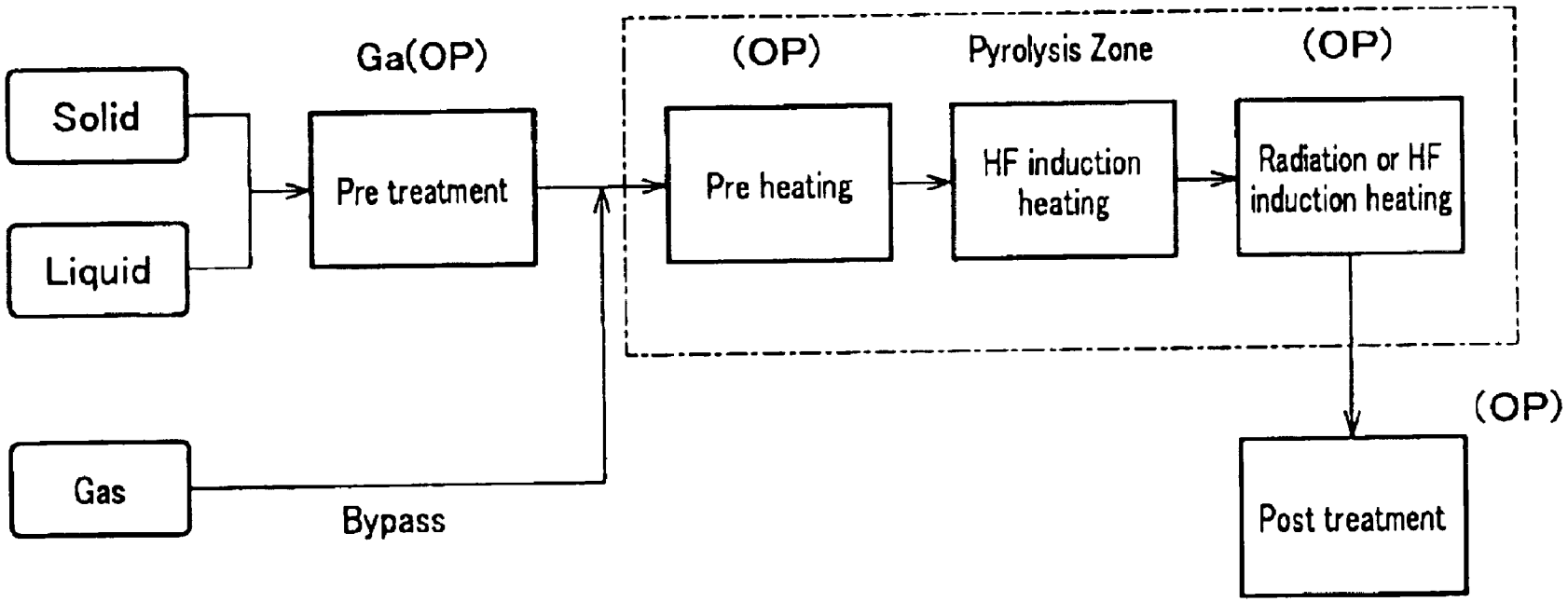
FIG. 2 is a flowchart, showing the flow of this invention's high-frequency induction heating device and an organic compound pyrolysis method that uses this heating device.

More over, the pyrolysis device (system) according to this invention has, for example, the configuration shown in FIG. 2.

When the substance to be treated is in a solid form, including sol and gel, or a liquid form, the substance is gasified through an optional treating device and then is passed through the pyrolysis zone. On the other hand, when the substance to be treated is in a gas form, the substance is bypassed through the optional pretreatment device, and directly enters in the pyrolysis zone. The pyrolysis zone comprises an optional preheating device, at least one high frequency induction heating device and an optional post-heating device (preferably a radiation heating and/or high frequency induction heating device).

First, the substance is heated to a prescribed temperature through the optional preheating device, and then pyrolyzed through the high frequency induction heating device according to the present invention. Optionally, the substance remaining un-decomposed is completely decomposed through the latter post-heating device, after which the decomposed products are transferred to the post-treatment device known per se. The post-treatment device may be a filter for recovery of carbon, or a trapping zone containing adsorbing agent and/or absorbing agent.

According to this configuration, the substance in any form, i.e., in a solid, liquid, or gas form, can be treated only in one line comprising the present device.

This invention will now be described in detail by referring to specific embodiments. In the following embodiments, PCBs, which are difficult to be decomposed, will be exemplified. However, those skilled in the art will appreciate that this invention is applicable to various organic compounds having decomposition energy lower than those of PCBs.

(First Embodiment)

A first embodiment of this invention shall now be described with reference to FIGS. 4 through 9.

This invention's organohalogen compound decomposition treatment device is a device that renders harmless organohalogen compounds and/or substances containing organohalogen compounds without discharging any hazardous substances whatsoever from the discharge port of the device.

Here, the organohalogen compounds and/or substances containing organohalogen compounds that can be subject to decomposition treatment by this invention's organohalogen compound decomposition treatment device are not limited to just organohalogen compounds themselves, in other words, PCBs themselves (both solids and liquid) but also refer to substances containing PCBs (capacitors, transformers, paper, wood, and soil), mixtures with other oils, as in the case of PCBs used in chemical plants, etc., and dioxins and substances containing dioxins.

Also, a PCBs-gasified gas refers to a gas resulting from the gasification of PCBs.

Figure 3:
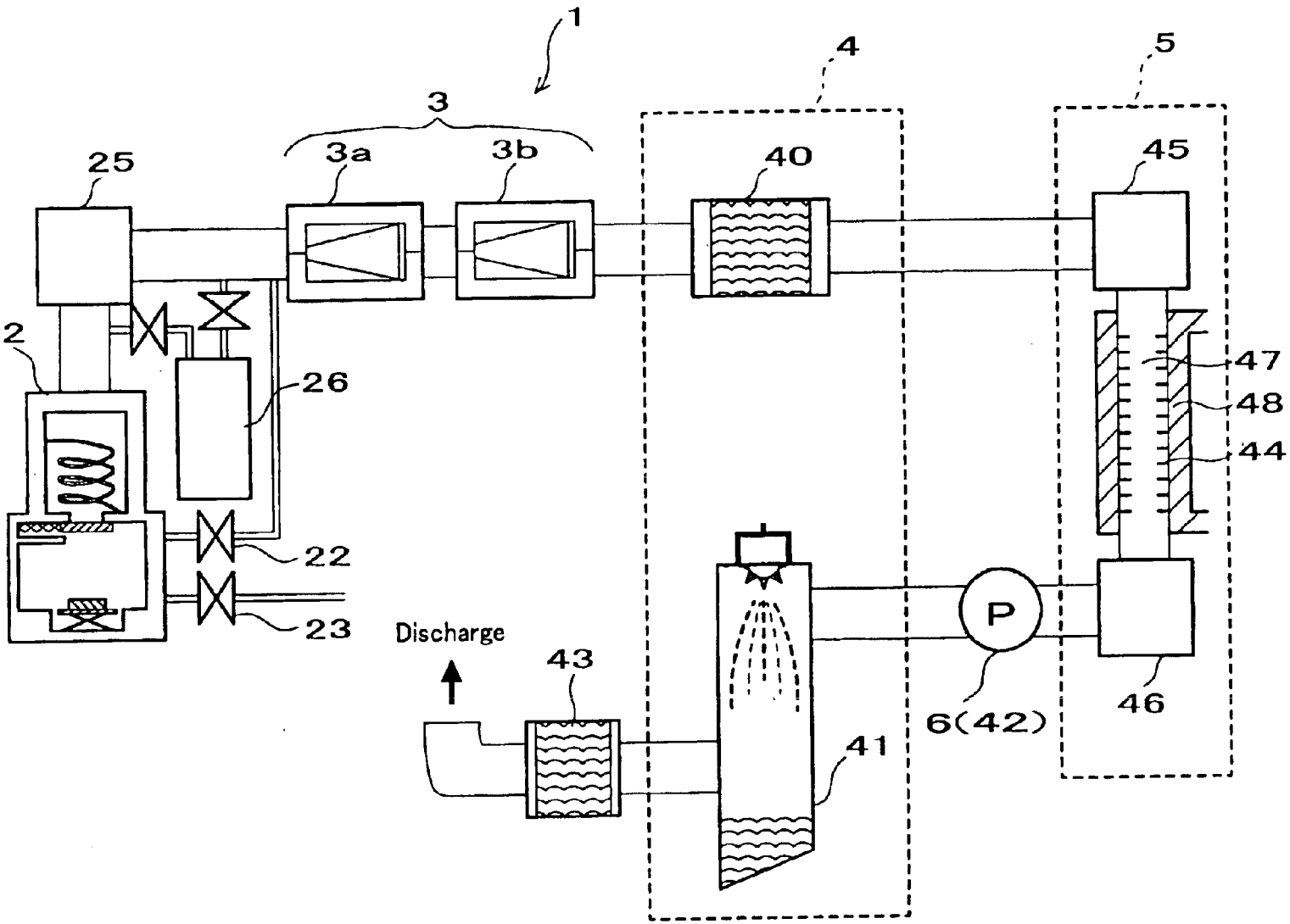
FIG. 3 is a schematic explanatory diagram, showing an organohalogen compound decomposition treatment device 1 of a first embodiment of this invention.

As shown in FIG. 3, this invention's organohalogen compound decomposition treatment device 1 comprises a gasifying means 2, pyrolysis means 3, trapping means 4, pressure differential generating means 5, and pressure reducing means 6 as the principal components.

The gasifying means 2 of this invention's organohalogen compound decomposition treatment device 1 heats PCBs and/or a PCBs-containing substance P (shall be referred to hereinafter as "treated object P") and thereby generates PCBs-gasified gas.

This gasifying means 2 comprises a lower chamber 10 and an upper chamber 11, which is disposed adjacent the upper part of lower chamber 10.

A heating container 12, which contains the above mentioned treated object P, is housed and subject to replacement with inert gas including, but being not limited to, a rare gas such as helium, argon, and neon, carbon dioxide, and/or nitrogen in the above mentioned lower chamber 10. Meanwhile, at the above mentioned upper chamber 11, the treated object P, which has been subject to replacement with an inert gas and has been sent out from inside the above mentioned lower chamber 10, is melted under a reduced pressure atmosphere to generate PCBs-gasified gas.

The shapes and sizes of this upper chamber 11 and lower chamber 10 are not restricted in particular, and, for example, a cylinder, quadratic prism, etc. may be selected as suited as the shape.

Also, though upper chamber 11 is smaller in size than lower chamber 10 in the present embodiment, these may be the same in size.

An opening 13, which puts upper chamber 11 and lower chamber 10 in communication, is provided at the connection surface between lower chamber 10 and upper chamber 11.

The shape of this opening 13 is not restricted in particular as long as it is a shape by which the heating container 12 that contains the above mentioned treated object P can be carried from inside lower chamber 10 to inside upper chamber 11. A shape (substantially circular) and size that are the same as those of the planar section of the inner circumferential face of a high-frequency coil 24, which shall be described later and is provided inside upper chamber 11, are preferable.

A shutter 14 is provided in a manner enabling sliding in the horizontal direction at the roof surface of lower chamber 10 of this gasifying means 2, that is, at the lower face of the above mentioned opening 13, and upper chamber 11 and lower chamber 10 can thereby be partitioned as suited.

Also, a carry-in entrance 15 is provided at a side face of lower chamber 10 of gasifying means 2. Thus treated object P, after being contained in heating container 12, is carried inside lower chamber 10 via this carry-in entrance 15.

Here, the material of heating container 12 is not restricted in particular as long as it enables heat to be transmitted efficiently to treated object P. Examples of such a material include, but are not restricted to, molybdenum, stainless steel, dielectric ceramics, carbon, etc. With the present embodiment a heating container 12 that is made of molybdenum is used.

The shape of heating container 12 is also not restricted in particular. However with prior-art indirect heating methods, when the distance between treated object P and the heating part is far, there was the disadvantage that temperature control response was poor and thus a temperature at which PCBs and oils boil could not be maintained.

Figure 5A:
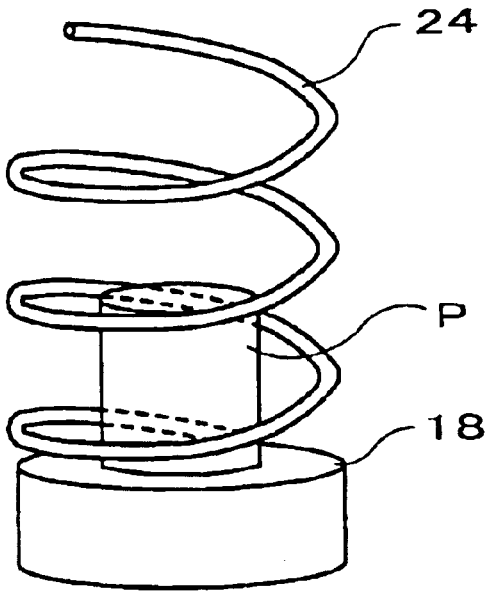
FIG. 5A is an enlarged view of the principal parts of an upper chamber 11 of gasifying means 2 and FIG. 5B is a perspective view of a heating container 12 used in organohalogen compound decomposition treatment device 1.
Figure 5B:
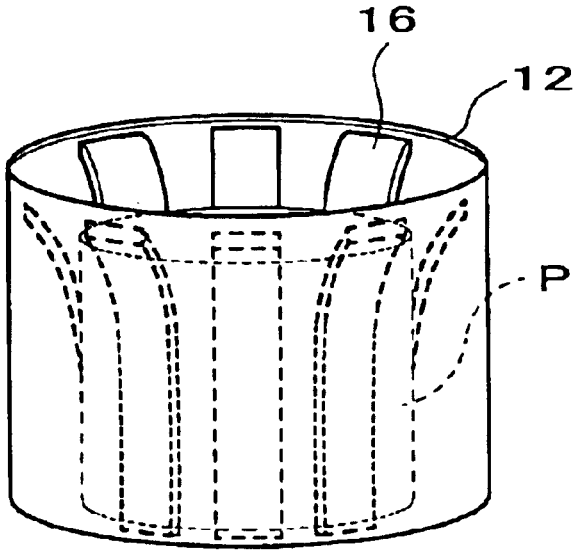

Thus in order to resolve this disadvantage, the container used in the present embodiment has a plurality of blades 16, each comprising a heat-resistant metal, provided at predetermined intervals along the inner peripheral surface of heating container 12 in a manner whereby they protrude towards the center of the container, and these blades 16 are arranged to contact treated object P to enable heating to be performed by efficient heat transfer (see FIG. 5B).

In order to enable blades 16 to contact treated object P regardless of the size of treated object P, a thin, soft, rectangular plate is preferable as the form of blade 16. Also with regard to the method of positioning the blades 16, an arrangement is preferable wherein the ends at one side in the length direction of the above mentioned blades 16 are fixed along the inner peripheral surface of heating container 12 at suitable intervals and the respective ends at the other side are bent towards the bottom part of heating container 12 while facing toward the axial center of heating container 12.

Alternatively, treated object P may be arranged to be carried into lower chamber 10 of gasifying means 2 with it being placed not inside heating container 12 but inside a drum made of the same material as heating container 12.

Figure 4:
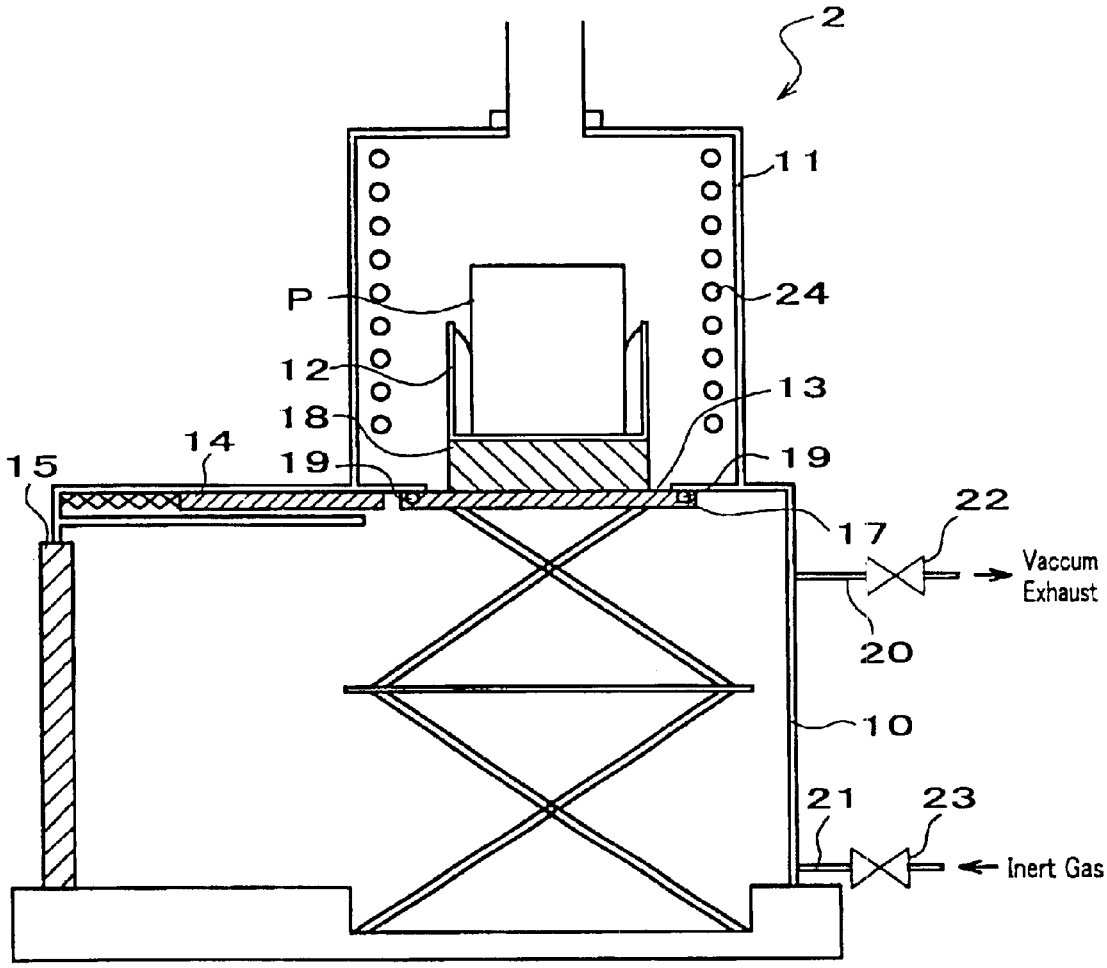
FIG. 4 is a schematic sectional view of gasifying means 2.

A lift 17 is provided in a manner enabling rising and lowering inside lower chamber 10 of gasifying means 2 (see FIG. 4). At substantially the central part of the upper surface of this lift 17 is provided an alumina pedestal 18, on the upper surface of which is placed the heating container 12 that has been carried in from carry-in entrance 15.

A circular packing 19, for partitioning lower chamber 10 from upper chamber 11 while maintaining the sealing of upper chamber 11, is provided at the upper part of lift 17 with alumina pedestal 18 being equipped at its central part.

The interior of upper chamber 11 can thus be sealed tightly by making the above mentioned packing 19 of circular shape contact the roof surface of lower chamber 10 upon opening the above mentioned shutter 14 provided at the opening 13 that puts lower chamber 10 and upper chamber 11 in communication and sending the heating container 12, which contains treated object P, to the inner side of the below-described high-frequency coil 24 provided inside upper chamber 11.

Lower chamber 10 is also provided with a vacuum exhaust pipe 20 for exhausting the air inside lower chamber 10 and an inert gas introduction pipe 21 for introducing inert gas into lower chamber 10 from a gas cylinder (not shown) filled with the inert gas such as described above. Valves 22 and 23 are provided respectively at the downstream side of vacuum exhaust pipe 20 and the upstream side of inert gas introduction pipe 21.

The interior of lower chamber 10 can thus be replaced by inert gas to eliminate the air and the moisture contained in the air inside the treated object P that has been carried into lower chamber 10 and inside the lower chamber 10.

The layout positions of vacuum exhaust pipe 20 and inert gas introduction pipe 21 are not restricted in particular as long as the positions enable inert gas replacement of the interior of lower chamber 10.

With the present embodiment, the above mentioned vacuum exhaust pipe 20 provided at lower chamber 10 is connected, via the below-described pyrolysis means 3, trapping means 4, and pressure differential generating means 5, to a vacuum pump 42, which is the pressure reducing means 6 (see FIG. 3). A reduced pressure atmosphere is thus arranged to be formed inside lower chamber 10 by means of this vacuum pump 42.

The method for forming a reduced pressure atmosphere inside lower chamber 10 is not restricted to the above arrangement and an arrangement is also possible wherein a vacuum pump is separately provided for forming a reduced atmosphere inside just the above mentioned lower chamber 10.

Also, in place of an arrangement wherein the supply of inert gas into lower chamber 10 is achieved by means of a gas cylinder (not shown) that is filled with inert gas and connected to inert gas introduction pipe 21, inert gas may be supplied by means of a liquid nitrogen supply device (not shown) that is used in the below-described pressure differential generating means or by means of the gas resulting from gasification of the liquid nitrogen used in pressure differential generating means 5.

The high-frequency coil 24, into the inner side of which the heating container 12 that has been sent from inside lower chamber 10 by lift 17 is inserted, is disposed in upper chamber 11 of gasifying means 2 in manner whereby it spirals from the lower part to the upper part of upper chamber 11 and the space at the inner side takes on a substantially cylindrical form (see FIGS. 4 and 5A).

Furthermore, a pressure sensor (not shown), such as a Pirani gauge for measuring the pressure inside this upper chamber 11 is disposed inside upper chamber 11.

For the melting of the treated object P and gasification of PCBs by induction heating by high frequency, high-frequency coil 24 is connected to a high-frequency power supply (not shown) that is equipped with an inverter circuit and arranged to enable control of the heating temperature as suited.

The control of this high-frequency coil 24 is generally performed by a voltage amplification method. However in the case of a voltage amplification method, a discharge occurs inside the vacuum chamber when the voltage becomes 400V or more and this may impede the temperature control. Thus with the present embodiment, a current amplification method, with which such problems will not occur, is employed.

The employment of a high-frequency induction heating method for the heating for melting the treated object P provides various advantages such as the time required for raising the temperature from an ordinary temperature to 1000° C. being a short time of approximately 0.5 seconds, it being possible to concentrate the heating energy just to the inner side of high-frequency coil 24, and it being possible to set temperatures in the range of 100° C. to 3000° C. (heat resistance temperature of carbon) in accordance to the power supply used and the heat resistance temperature of treated object P. The employment of a high-frequency power supply using an inverter circuit provides further advantages as it being possible to maintain the heating temperature within ±5° C. of a set value due to good following of the power supplying amount to temperature changes of the treated object P and it being possible to control the temperature rapidly and accurately in response to pressure rises within a furnace when PCBs-gasified gas is generated from treated object P, thus enabling the boiling point of treated object P at that pressure to be maintained in a stable manner.

A vacuum valve 25 is provided in a manner enabling opening and closing at the downstream side of upper chamber 11 of gasifying means 2 (see FIG. 3).

This vacuum valve 25 is provided to put upper chamber 11 in communication with the above mentioned pyrolysis means 3 and enable the PCBs-gasified gas generated inside gasifying means 2 to be supplied to pyrolysis means 3 when a negative pressure state, due to the below-described pressure differential generating means 5, or a reduced pressure state, due to vacuum pump 42, is formed inside this invention's organohalogen compound decomposition treatment device 1.

With organohalogen compound decomposition treatment device 1 of the present embodiment, an oil trap 26 is connected via a bypass piping to the piping that connects the above mentioned gasifying means 2 with the above mentioned pyrolysis means 3.

Thus in the case where the PCBs-containing substance to be melted inside the above mentioned gasifying means 2 is a mixture with another low boiling point oil, etc., the low boiling point components contained in the PCBs-containing substance can be separated and recovered inside oil trap 26 by heating treated object P at a temperature less than or equal to the gasification temperature of the PCBs.

The pyrolysis means 3 of this invention's organohalogen compound decomposition treatment device 1 converts the PCBs-gasified gas generated at the above-described gasifying means 2 into harmless decomposition gas by contact pyrolysis by contact with a heating unit and by pyrolysis by radiant heat in the process of passage through holes formed in a heating unit.

Figure 6A:
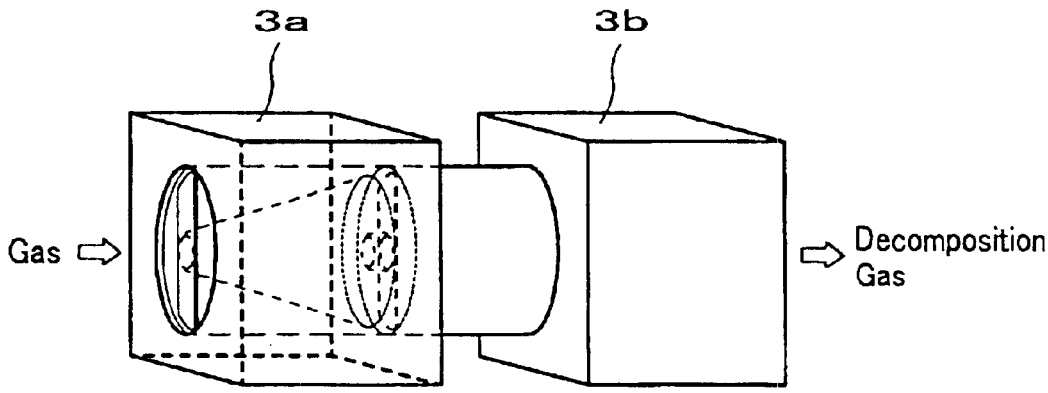
FIGS. 6A and 6B are perspective arrangement diagrams of a pyrolysis means 3.
Figure 6B:
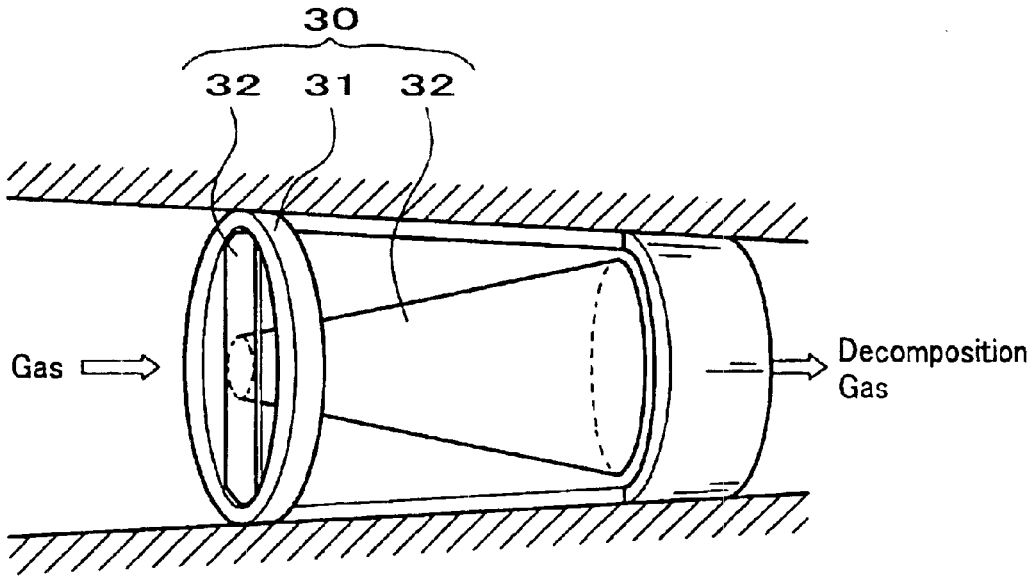

This pyrolysis means 3 is connected to the downstream side of the above-described gasifying means 2 via vacuum valve 25 and is equipped in its interior with a heating unit 30, which contacts and pyrolyzes the PCBs-gasified gas (see FIGS. 3 and 6).

This heating unit 30 comprises a cylindrical body 31, through the cylindrical interior of which the PCBs-gasified gas is passed through, a decomposing part 32, which is disposed inside the cylindrical body 31, and a holding member 33, which holds the above mentioned decomposing part 32 inside the cylindrical body 31.

Heating unit 30 of pyrolysis means 3 is heated across its entirety in order to pyrolyze the PCBs-gasified gas. The method for heating this heating unit 30 is not restricted in particular as long as heating unit 30 is arranged to be heated across its entirety. Microwave heating, dielectric heating, or induction heating, etc., may thus be selected as suited.

The heating temperature of heating unit 30 is not restricted in particular as long as the temperature enables cleavage of the benzene rings of the PCBs by heat and can be selected as suited from within a range of 1000 to 3000° C.

Heating unit 30 is thus arranged to employ the two pyrolysis methods of contact pyrolysis by contact with decomposing part 32 and pyrolysis by radiant heat in the process of passage between decomposing part 32 and cylindrical body 31 to pyrolyze the PCBs-gasified gas without fail.

The respective members (cylindrical body 31, decomposing part 32, and holding member 33) that comprise heating unit 30 are made of tungsten, molybdenum, nickel, and alloys thereof, stainless steel, or a heat-resistant steel such as incoloy, etc. Also, those skilled in the art will appreciate that a trace amount of niobium may be introduced into the heat-resistance material to enhance creep resistance. The material can be suitably selected depending upon a particular use, i.e., the intended temperature, cost, etc.

With the present embodiment, decomposing part 32 takes on the shape of a truncated cone. This truncated conical decomposing part 32 is disposed inside the above mentioned cylindrical body 31 in an orientation such that the gap between the inner wall surface of cylindrical body 31 becomes gradually smaller from the upstream side to the downstream side of cylindrical body 31, that is, in an orientation such that the cross-sectional area of the flow path of the PCBs-gasified gas becomes smaller from the upstream side to the downstream side.

This decomposing part 32 has one end thereof fixed to the above mentioned holding member 33 and is held inside cylindrical body 31 by holding member 33 being fitted in the cylindrical interior of cylindrical member 31.

In order to make heat be transmitted readily in the process of heating the heating unit 30, the truncated conical decomposing part 32 may be provided with the shape of a truncated cone with which the central part has been gouged out.

Figure 7A:
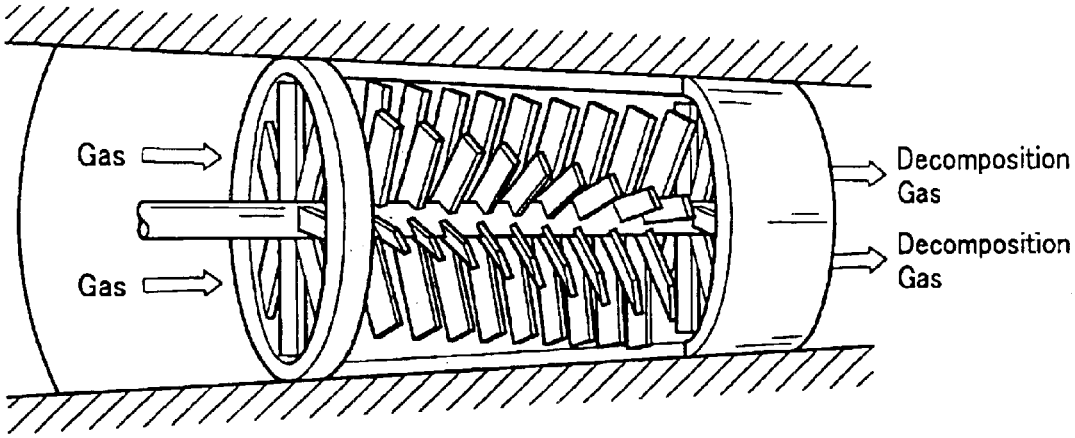
FIGS. 7A through 9B are diagrams of embodiments of a heating unit of pyrolysis means 3.

Furthermore in place of this truncated cone, a plurality of plates 35 may be provided in a radial manner as blades on the outer circumferential surface of cylinder as shown in FIG. 7A, a plurality of such arrangements may be equipped inside a cylinder from the upstream side to downstream side along the direction of flow of the PCBs-gasified gas, and the positions of the above mentioned blade plates may be shifted gradually to increase the area of collision (area of contact) with the PCBs-gasified gas.

Figure 7B:
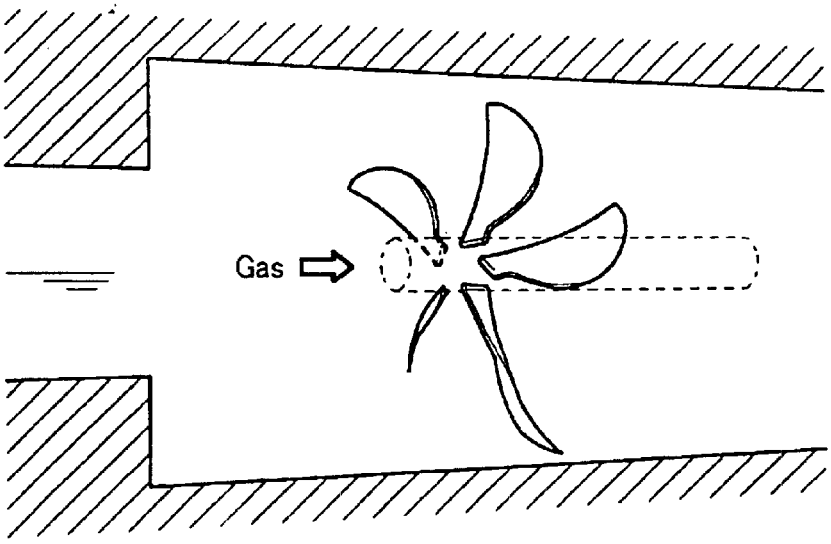

Heating unit 30 of pyrolysis means 3 may also have an arrangement wherein a plurality of blades are provided on an axial rod 36 from the upstream side to the downstream side along the direction of flow of the PCBs-gasified gas as shown in FIG. 7B and with these plurality of blades being housed within a cylinder and axial rod 36 being rotated by a motor, etc., (not shown).

In this case, the PCBs-gasified gas can be pyrolyzed while forcibly supplying the PCBs-gasified gas from the above-described gasifying means 2 by means of the rotation of axial rod 36 by the above mentioned motor.

Figure 8A:
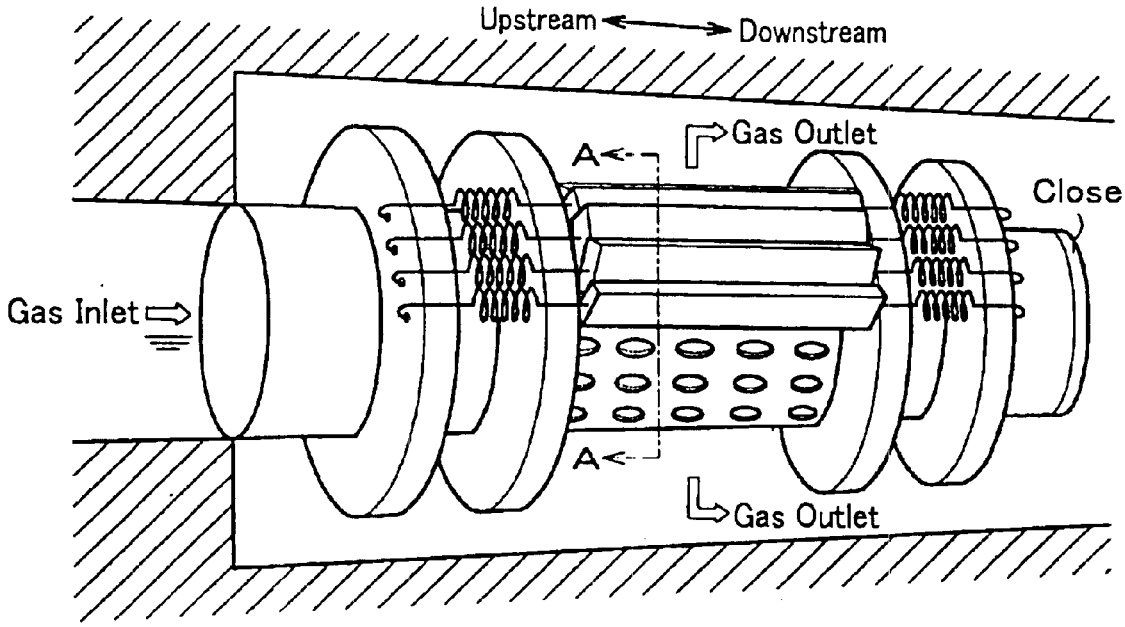
Figure 8B:
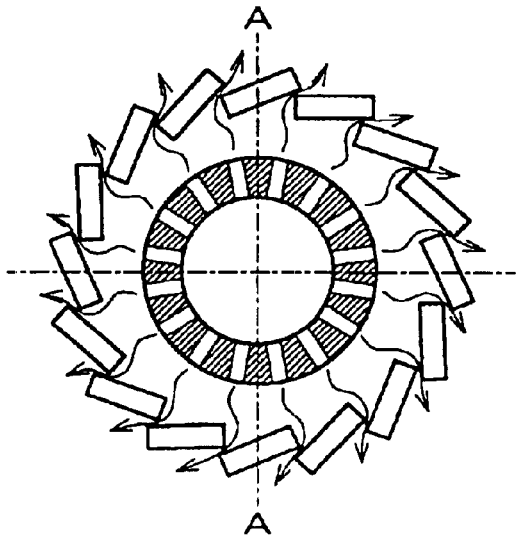

An arrangement is also possible wherein, as shown in FIG. 8, the PCBs-gasified gas is introduced inside a circular pipe, then exhausted from holes provided on the outer circumferential surface of this circular pipe, and then passed through gaps between plates, disposed so as to cover the upper surfaces of these holes, to thereby contact pyrolyze the PCBs-gasified gas.

Figure 9A:
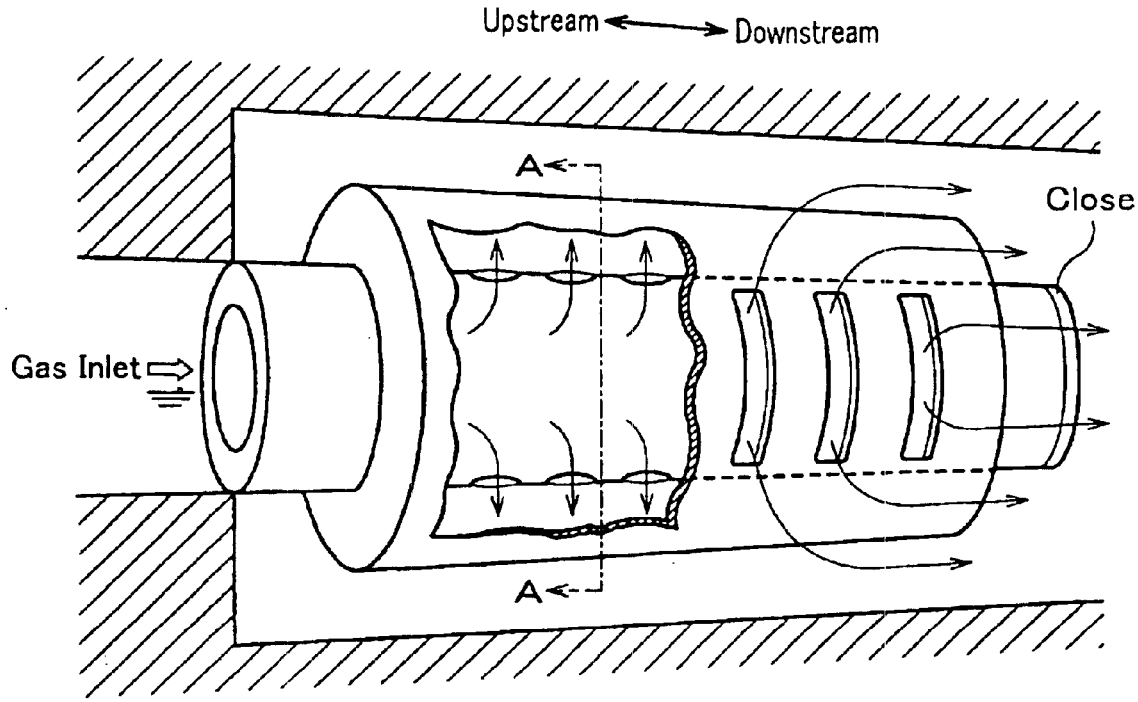
Figure 9B:
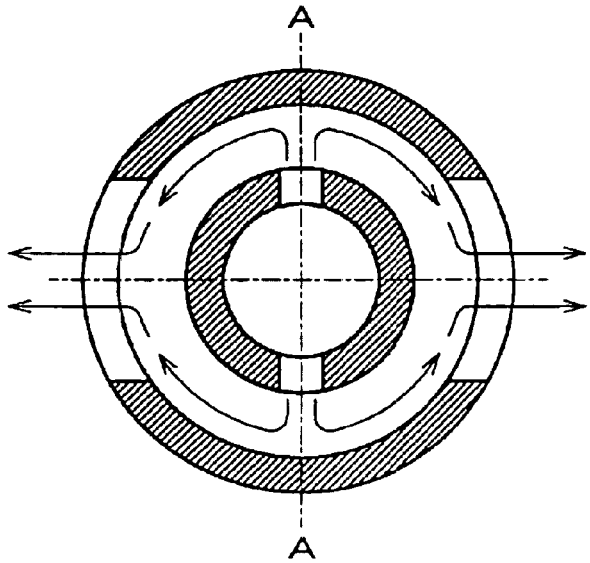

An arrangement is also possible wherein, as shown in FIG. 9, the PCBs-gasified gas is introduced inside a circular pipe, then exhausted from holes provided on the outer circumferential surface of this circular pipe, and then exhausted through slits provided on the outer circumferential surface of a cylinder that houses the circular pipe to successively perform contact pyrolysis and pyrolysis by radiant heat of the PCBs-gasified gas.

The method of configuring pyrolysis means 3 is not restricted in particular as long as the configuration is one by which the PCBs-gasified gas can be decomposed without fail and pyrolysis means 3 may be provided solitarily or in a plurality of serial or parallel stages.

In the case where the heating unit 30 equipped with decomposing part 32, which is shown in FIG. 6A, is used as the heating unit of pyrolysis means 3, a preferable method of configuring pyrolysis means 3 is to dispose two or more stages of pyrolysis means 3*a* and 3*b*, equipped with the same heating units 30, in series. This is because in this case, the flow of the PCBs-gasified gas inside pyrolysis means 3 becomes a turbulent flow and the probability of the gas molecules of the PCBs-gasified gas contacting the heating unit is thus increased.

The trapping means 4 of this invention's organohalogen compound decomposition treatment device 1 traps decomposition products (halogens, carbon content, etc.,) contained in the decomposition gas resulting from pyrolysis of the PCBs-gasified gas at the above-described pyrolysis means.

This trapping means 4 includes a dry trap 40 and wet trap 41.

The dry trap 40 of this trapping means 4 is formed by filling a circular pipe with a filler and the decomposition products contained in the above mentioned decomposition gas are adsorbed and trapped onto this filler. Examples of a filler that can be used include steel wool, activated carbon, nickel chips, etc.

With the present embodiment, nickel chips are used as the filler, and in this case, the carbon content in the above mentioned decomposition gas is adsorbed and recovered mainly as soot (carbon powder) by the catalytic action of nickel.

This dry trap 40 is interposed between the above-described pyrolysis means 3 and a butterfly valve 45 of the below-described pressure differential generating means 5.

The above mentioned wet trap 41 of trapping means 4 traps, inside a liquid, the decomposition products contained in the above mentioned decomposition gas that could not be eliminated completely by the above-described dry trap 40.

To be more specific, the decomposition gas, which has been rapidly cooled in the process of passage through the below-described pressure differential generating means 5, is lead through an atmosphere in which an aqueous solution of sodium hydroxide is made into a mist to recover the halogens in the decomposition gas as salts and the carbon content as soot (carbon powder). When the content of halogens contained in the above mentioned decomposition gas can be presumed to be low, an arrangement is also possible wherein water is used in place of the above mentioned aqueous solution of sodium hydroxide.

This wet trap 41 is interposed between a filter 43 to be described below and vacuum pump 42, which is the pressure reducing means 6.

The organohalogen compound decomposition treatment device 1 of the present embodiment is of an arrangement equipped with the below-described pressure differential generating means 5. Wet trap 41 is thus positioned at the downstream side of pressure differential generating means 5. Thus in the case of a device arrangement wherein the above mentioned pressure differential generating means 5 is not equipped, the wet trap 41 may be connected directly to the downstream side of the above-described dry trap 40.

Also, the salts and carbon powder recovered in aqueous solution by wet trap 41 are separated and recovered at a waste liquid treatment device (not shown). After separation of the salts and carbon powder, the aqueous solution of sodium hydroxide is arranged to be reused in wet trap 41 upon being adjusted to a predetermined concentration by addition of sodium hydroxide anew at a concentration adjustment device (not shown).

Thus by there being provided the dry trap 40 and wet trap 41 of trapping means 4, the decomposition products inside the above mentioned decomposition gas are not released to the exterior of organohalogen compound decomposition treatment device 1.

The pressure differential generating means 5 of this invention's organohalogen compound decomposition treatment device 1 makes the part from the above mentioned gasifying means 2, through pyrolysis means 3, and to trapping means 4 a closed system, isolates a part of the above-described trapping means 4 in this closed system to form an isolated part, and cools this isolated part to generate a pressure differential between the isolated part and non-isolated part inside the closed system.

This pressure differential generating means 5 comprises a butterfly valve 45, a vacuum valve 46, a piping 47, which connects the above mentioned butterfly valve 45 with vacuum valve 46, and a jacket type cooling pipe 48, which is provided for cooling the interior of piping 47.

By closing, the vacuum valve 46 of this pressure differential generating means 5 makes the part from the above-described gasifying means 2, through pyrolysis means 3, and to vacuum valve 46 a closed system.

By closing, the butterfly valve 45 of this pressure differential generating means 5 isolates the piping from butterfly valve 45 to the above-described vacuum valve 46 inside the closed system formed by the above mentioned vacuum valve 46, thereby forming the isolated part.

By passage of liquid nitrogen or other coolant through its interior, the cooling pipe 48 of pressure differential generating means 5 rapidly cools the interior of piping 47, that is, the isolated part formed by the above mentioned butterfly valve 45 and vacuum valve 46.

Thus at pressure differential generating means 5, by rapidly cooling the above mentioned isolated part, in other words, the interior of piping 47, a pressure differential is generated between the isolated part and non-isolated part of the above mentioned closed system.

Thus when in the condition where a pressure differential has been generated, the butterfly valve 45 of pressure differential generating means 5 is opened and the isolated part and non-isolated part are put in communication, the PCBs-gasified gas that had been generated at the above-described gasifying means 2 is sucked in due to the pressure differential and is guided to the downstream side (pyrolysis means 3 and trapping means 4) of gasifying means 2.

This pressure differential generating means 5 thus performs the same function as the vacuum pump 42 of pressure reducing means 6 to be described later.

By thus guiding the PCBs-gasified gas by means of pressure differential generating means 5, all of the treatment of PCBs in this organohalogen compound decomposition treatment device 1 are carried out within a closed system.

Thus even if undecomposed PCBs-gasified gas or other hazardous substances are generated, these will not leak out to the exterior of organohalogen compound decomposition treatment device 1.

In addition to the above actions and effects, the rapid cooling of the interior of the above mentioned piping 47 in pressure differential generating means 5 provides the following effect.

That is, since the decomposition gas, which could not be trapped fully by the dry trap 40 positioned upstream the pressure differential generating means 5, is rapidly cooled at the above mentioned piping 47, the effect of preventing the generation of carbon tetrachloride ($CCl_4$) due to recombination of the decomposition products contained in the decomposition gas is provided.

Also, for more efficient cooling of the above mentioned decomposition gas inside this piping 47, a plurality of fins 44 may be provided in a detachable manner inside piping 47 to increase the area of contact with the above mentioned decomposition gas, and these fins 44 may also be arranged to adsorb and recover the above mentioned decomposition gas.

Here, various materials may be used as the material of fins 44. Examples include stainless steel, nickel alloy, etc. When a nickel alloy is used, more of the decomposition products in the decomposition gas will be adsorbed as carbon due to the catalytic effect of nickel. A nickel alloy is thus preferable as the material of fins 44.

Also, the method of rapidly cooling the above mentioned piping 47 is not restricted in particular as long as it is a method by which a negative pressure can be generated within the device by the rapid cooling of the interior of piping 47.

Also, the pressure reducing means 6 of this invention's organohalogen compound decomposition treatment device 1 forms a reduced pressure atmosphere at a part extending from the above mentioned gasifying means 2 to trapping means 4 and replaces the interior of lower chamber 10 of the above-described gasifying means 2 with inert gas.

To be more specific, pressure reducing means 6 is a vacuum pump 42, and this vacuum pump 42 has one end connected via vacuum valve 46 to a stage downstream the above-described pressure difference generating means 5 and has the other end connected to wet trap 41 to form a reduced pressure atmosphere inside this invention's organohalogen compound decomposition treatment device 1 and replace the interior of the above-described lower chamber 10 with inert gas.

A filter 43, filled with activated carbon, is connected to the downstream side of the above-described trapping means 4 in order to make the exhaust gas that is generated during operation of the above-described vacuum pump 42 be exhausted outside the device after being treated completely of the impurities, etc., in the exhaust gas (see FIG. 3).

This invention's organohalogen compound decomposition treatment method shall now be described.

The treated object P, which has been carried inside lower chamber 10 of gasifying means 2 via carry-in entrance 15 in the condition where it is contained in the above-described heating container 12, is first subject to nitrogen replacement inside the above-described lower chamber 10 and is thereafter sent to the inner side of high-frequency coil 24 disposed inside upper chamber 11. Treated object P is then melted by induction heating by high frequency under a negative pressure or reduced pressure atmosphere. In this process, the PCBs contained in the treated object P are gasified and PCBs-gasified gas is thus generated (gasifying step).

Since the interior of this invention's organohalogen compound decomposition treatment device 1 is maintained at a negative pressure or reduced pressure atmosphere, the PCBs-gasified gas that has been generated inside the above-described gasifying means 2 is sucked towards the pyrolysis means 3 that is positioned at a stage downstream the gasifying means 2. The PCBs-gasified gas that has been supplied into pyrolysis means 3 is pyrolyzed into decomposition gas, comprising halogens and carbon, upon contact with the heating unit 30, which is disposed inside pyrolysis means 3 and has been heated by microwave, etc., to a temperature at which PCBs are pyrolyzed, and is also pyrolyzed by the radiant heat in the process of passing through the gaps inside heating unit 30 (pyrolysis process).

The decomposition gas that has been generated at the above-described pyrolysis means 3 is supplied to the trapping means 4 that is positioned at the downstream side of pyrolysis means 3. At dry trap 40, which is disposed at an upstream stage of trapping means 4 and is filled with nickel chips, the carbon content in the decomposition gas is trapped as soot (carbon powder) by the catalytic action of nickel. The decomposition gas that could not be captured by this dry trap 40 is rapidly cooled at the pressure differential generating means 5, disposed at a downstream stage, to restrain the generation of carbon tetrachloride from the decomposition gas. Then by passage through a mist of an aqueous solution of sodium hydroxide, which has been adjusted to a predetermined concentration, in wet trap 6 that is positioned at a stage further downstream, the chlorine in the decomposition gas is recovered as sodium chloride salt and the carbon content is recovered as carbon (trapping step).

(Second Embodiment)

A second embodiment of this invention shall now be described with reference to the attached drawings.

This invention's gaseous organohalogen compound decomposition treatment device is a device that pyrolyzes and renders harmless hazardous gases, such as organohalogen compounds supplied in the gaseous state, by high frequency induction heating.

A liquid organohalogen compound decomposition treatment device is a device that heats organohalogen compounds of liquid form to convert these compounds once into gaseous organohalogen compounds and renders these gaseous organohalogen compounds harmless by pyrolyzing the compounds by heating.

Figure 10:
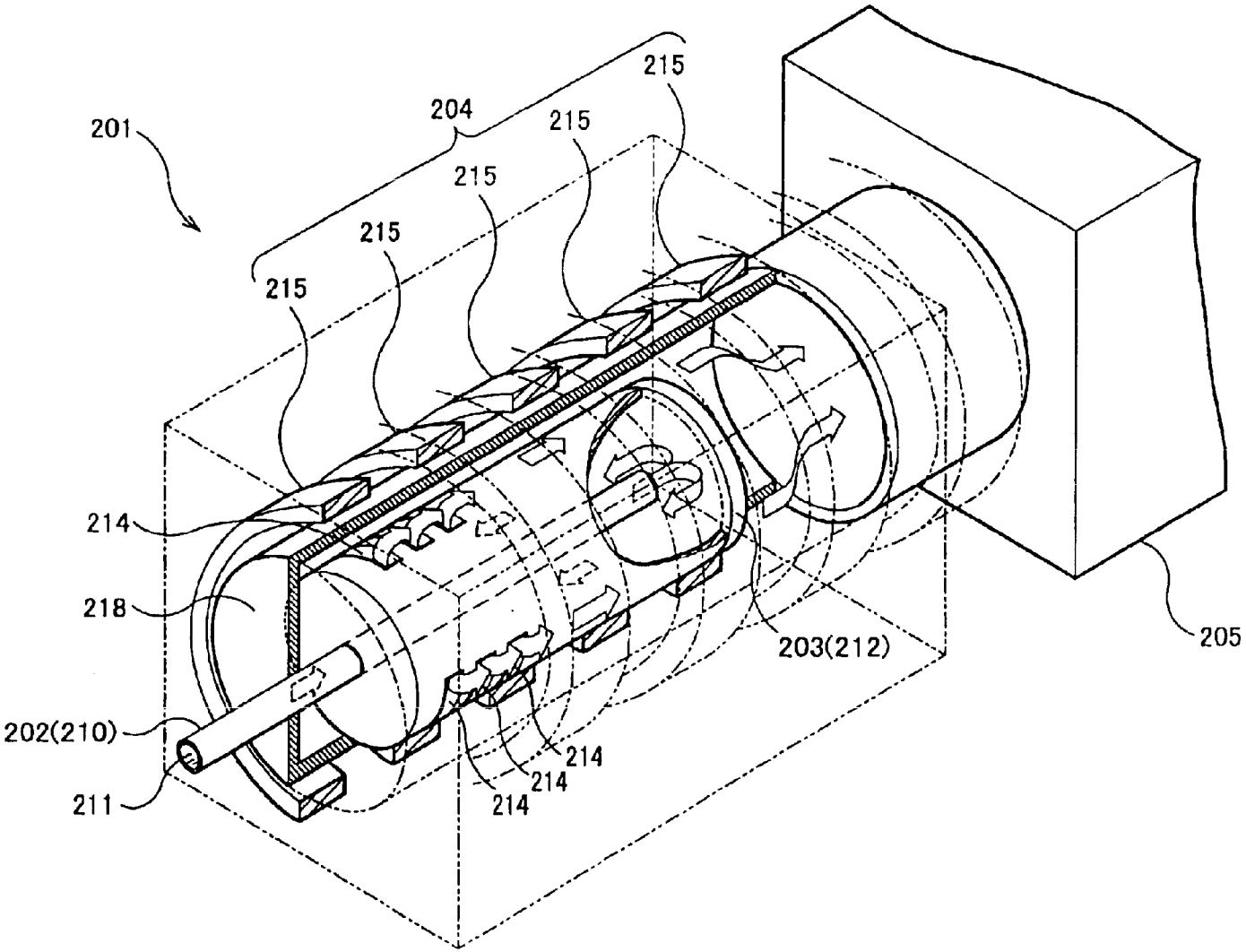
FIG. 10 is a schematic arrangement diagram of this invention's gaseous organohalogen compound decomposition treatment device 201.
Figure 11B:
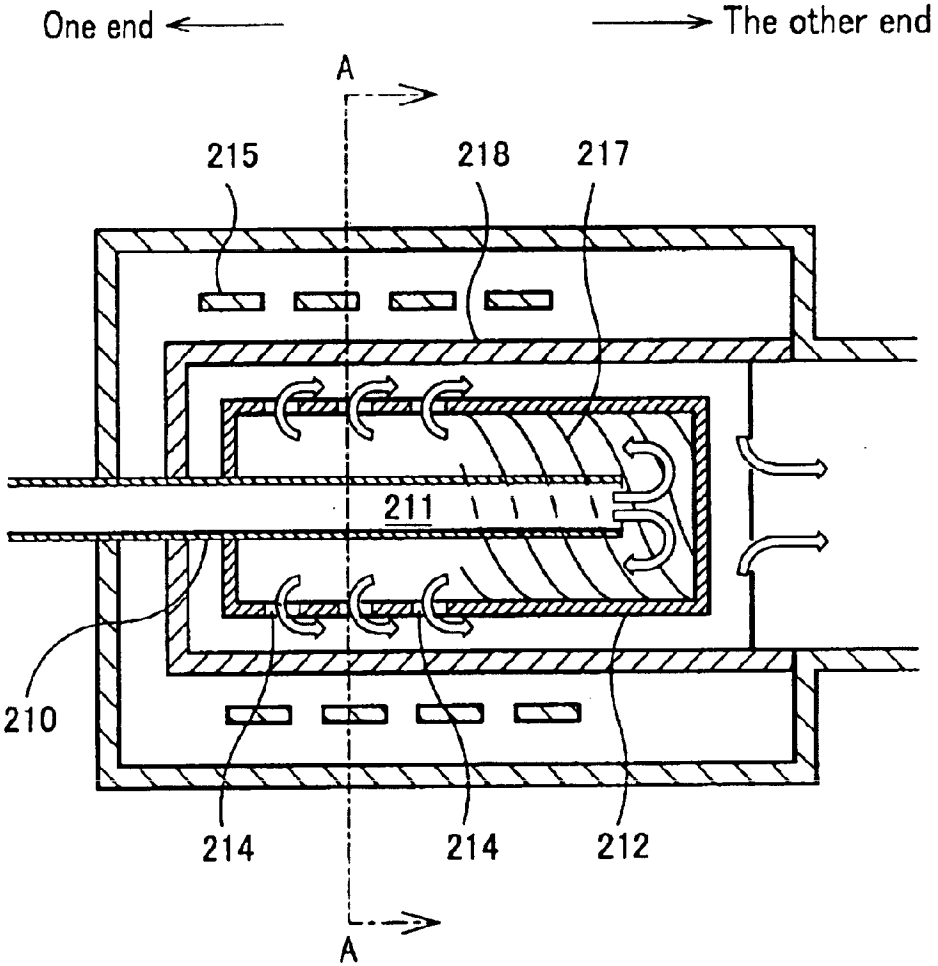
FIGS. 11A and 11B are both sectional views of the principal parts of this invention's gaseous organohalogen compound decomposition treatment device 201.
Figure 11A:
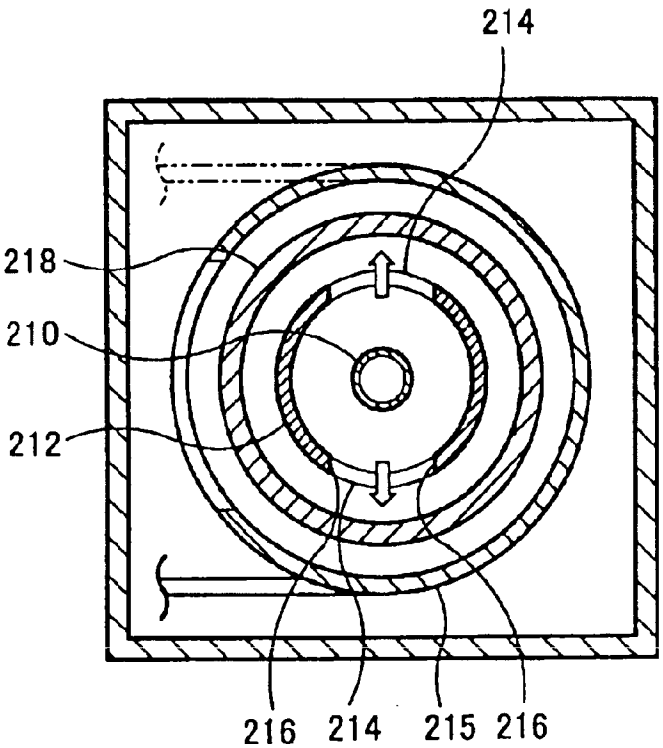

FIG. 10 is a schematic arrangement diagram of this invention's gaseous organohalogen compound decomposition treatment device 201. FIGS. 11A and 11B are both sectional views of the principal parts of this invention's gaseous organohalogen compound decomposition treatment device 201.

This gaseous organohalogen compound decomposition treatment device 201 comprises a gas introduction means 202, pyrolysis means 203, heating means 204, and gas exhausting means 205.

The gas introduction means 202 of gaseous organohalogen compound decomposition treatment device 201 guides gaseous PCBs and other various hazardous gases (shall be referred to hereinafter as "treated gas") to the pyrolysis means 203, which shall be described later.

As shown in FIGS. 10 and 11, with the present embodiment, gas introduction means 202 is a circular pipe 210 of predetermined length, and the treated gas is passed into the hole 211 of this circular pipe 210 and guided into the interior of a cylinder 212 of the pyrolysis means 203, which shall be described later.

The material that makes up this circular pipe 210 is not restricted in particular as long as it is a material having such characteristics as being high in heat resistance, low in expansion and contraction due to heat, and not readily heated by induction. In the present embodiment, alumina is used.

Also, the diameter of circular pipe 210 may be selected as suited in accordance to the size of gaseous organohalogen compound decomposition treatment device 201 and the treatment amount of the treated gas. In the present embodiment, a circular pipe 210 of Φ28 mm is used.

The pyrolysis means 203 of gaseous organohalogen compound decomposition treatment device 201 applies the two pyrolysis stages of contact pyrolysis by contact with a heating unit and pyrolysis by radiant heat by passage through holes (slits 214) formed in the heating unit to the treated gas introduced by the above-described gas introduction means 202 to convert the treated gas to a harmless gaseous substance.

The above mentioned heating unit of this embodiment is cylinder 212, which is sealed at both ends (see FIGS. 10 to 11B). Circular pipe 210, which is the above-described gas introduction means 202, is inserted into one end face of cylinder 212 and the tip of the inserted circular pipe 210 is positioned so as to face the other end side of the interior of cylinder 212.

At the outer circumferential surface of cylinder 212 at the one end side into which the above-described circular pipe 210 is inserted, a plurality of slits 214, which put the interior and exterior of cylinder 212 in communication, are provided from one end side towards the other end side of cylinder 212.

These slits 214 are provided at two parts at positions that are point symmetric with respect to the central part of cylinder 212 (see FIG. 11A).

The treated gas that has been supplied to this heating unit is thus always supplied to the other end side of the interior of the above-described cylinder 212. The treated gas that has been guided to the other end side of the interior of cylinder 212 flows inside the cylinder 212 and moves from the other end side to the one end side at which the above mentioned slits 214 are provided and are exhausted to the exterior of cylinder 212 by passage through these slits 214.

Here, since the cylinder 212 is heated by the heating means 204 to be described later, the treated gas that has been guided inside cylinder 212 contacts the inner wall surface of the heated cylinder 212 and becomes pyrolyzed in the process of moving inside cylinder 212 to the side (one end side) at which the above-described slits 214 are provided. Also, even if the treated gas does not contact the inner wall surface of cylinder 212, since the slits 214 provided in cylinder 212 are heated to a high temperature due to the reasons given below, the treated gas is decomposed by radiant heat in the process of passage through the slits 214.

Treated gas is thus not exhausted from slits 214 of cylinder 212 but only decomposition gas, which has been decomposed to a harmless state, is exhausted from slits 214.

Here, the diameter of cylinder 212 may be selected as suited in accordance to the size of the device and treatment amount of treated gas. In the present embodiment, a cylinder 212 of Φ35 mm is used.

Also, the material that makes up the heating unit may be selected as suited from tungsten, molybdenum, nickel, and alloys thereof, stainless steel, or a heat-resistant steel such as incoloy, etc.

The use of molybdenum for the heating unit provides such advantages of molybdenum as having a heat resistance temperature of 2800° C. and thus being better in heat resistance in comparison to other materials and providing white light upon being heated and being high in energy density, thereby enabling decomposition of the treated gas by radiant heat even if contact is not made.

Also, when incoloy, which is a nickel alloy, is used for the heating unit, the advantage that the organic substances in the treated gas that contacts the heating unit are converted into and recovered as carbon by the catalytic action of nickel is provided.

Thus it is more preferable to use incoloy than stainless steel and more preferable to use molybdenum than incoloy as the material that makes up the heating unit.

Also, the number and slit width of the slits 214 provided in cylinder 212 may be selected as suited. With the present embodiment, the slit width is 2 mm.

With the present embodiment, a high-frequency coil 215, which is the heating means 204, is provided at a position that is separated from the outer circumferential surface of the heating unit by a predetermined distance as shown in FIG. 10. Thus when a high-frequency current is made to flow through high-frequency coil 215 for heating the heating unit, an eddy current arises on the outer circumferential surface of cylinder 212 of the heating unit.

In this process, since a current cannot flow at the slit 214 parts, current becomes concentrated at the respective parts between slits 214 (these parts shall be referred to hereinafter as "outer circumference parts 216"). As a result, the outer circumference parts 216 become heated to a higher temperature than other parts of cylinder 212. The spaces inside the slits 214 thus become high temperature bodies as well.

Thus even if the treated gas is guided to these slits 214 without contacting the inner wall surface of the above-described cylinder 212, the treated gas will be pyrolyzed without fail by the radiant heat in the process of passage through slits 214.

Furthermore, a rifling 217 may be provided on the inner wall surface of cylinder 212 from the other end side towards the one end side of cylinder 212 as shown in FIG. 11B. In this case, the treated gas that has been supplied to the other end side of cylinder 212 will be guided to slits 214 provided at the one end side while being stirred in spiraling manner by the existence of rifling 217. The chances of contact of the treated gas with cylinder 212 is thus increased and the treated gas is contact pyrolyzed more efficiently.

The heating means 204 of this gaseous organohalogen compound decomposition treatment device 201 heats the above-described pyrolysis means 203.

This heating means 204 comprises an alumina chamber 218, which houses the above-described pyrolysis means 203 in its interior, and a high-frequency coil 215, which is wound in spiraling manner from one end side towards the other end side of alumina chamber 218 at a position separated from the outer circumferential surface of alumina chamber 218 by a predetermined distance (see FIGS. 10 and 11).

This high-frequency coil 215 is connected to a current controlled type high-frequency power supply (not shown). Thus by changing the power that is made to flow through high-frequency coil 215, the pyrolysis means 203 housed inside the above mentioned alumina chamber 218 is induction heated and thus heated as suited to a desired temperature.

The gas exhausting means 205 of this gaseous organohalogen compound decomposition treatment device 201 guides the treated gas into the above-described pyrolysis means 203 and makes the decomposition gas, formed by decomposition of the treated gas at pyrolysis means 203, be exhausted from the above-described pyrolysis means 203.

In the present embodiment, this gas exhausting means 205 is a general vacuum pump (not shown) that is connected via a piping to the downstream side of the above-described pyrolysis means 203.

This vacuum pump sucks in the treated gas via circular pipe 210 of the above-described gas introduction means 202 and guides the treated gas into cylinder 212 of the above-described pyrolysis means 203. The vacuum pump then sucks out and makes the decomposition gas, which arises from the pyrolysis of the treated gas inside cylinder 212 and/or in the process of passage through the slits 214 provided in cylinder 212, be exhausted to the downstream side of pyrolysis means 203.

If necessary, a trapping means, which recovers decomposition products contained in the above mentioned decomposition gas by adsorption or reaction, may be provided between gas exhausting means 205 and the above-described pyrolysis means 203.

(Third Embodiment)

Figure 12B:
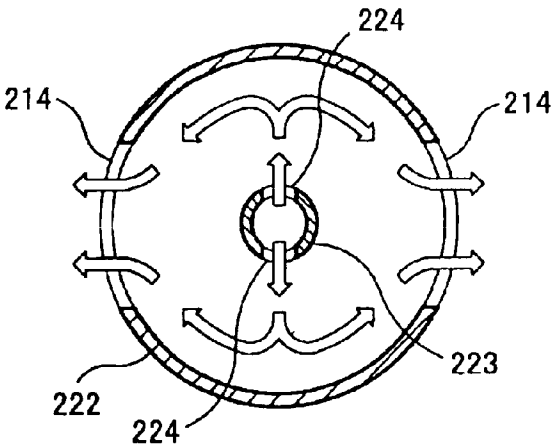
FIG. 12 is a schematic arrangement diagram of a third embodiment of this invention's gaseous organohalogen compound decomposition treatment device.
Figure 12A:
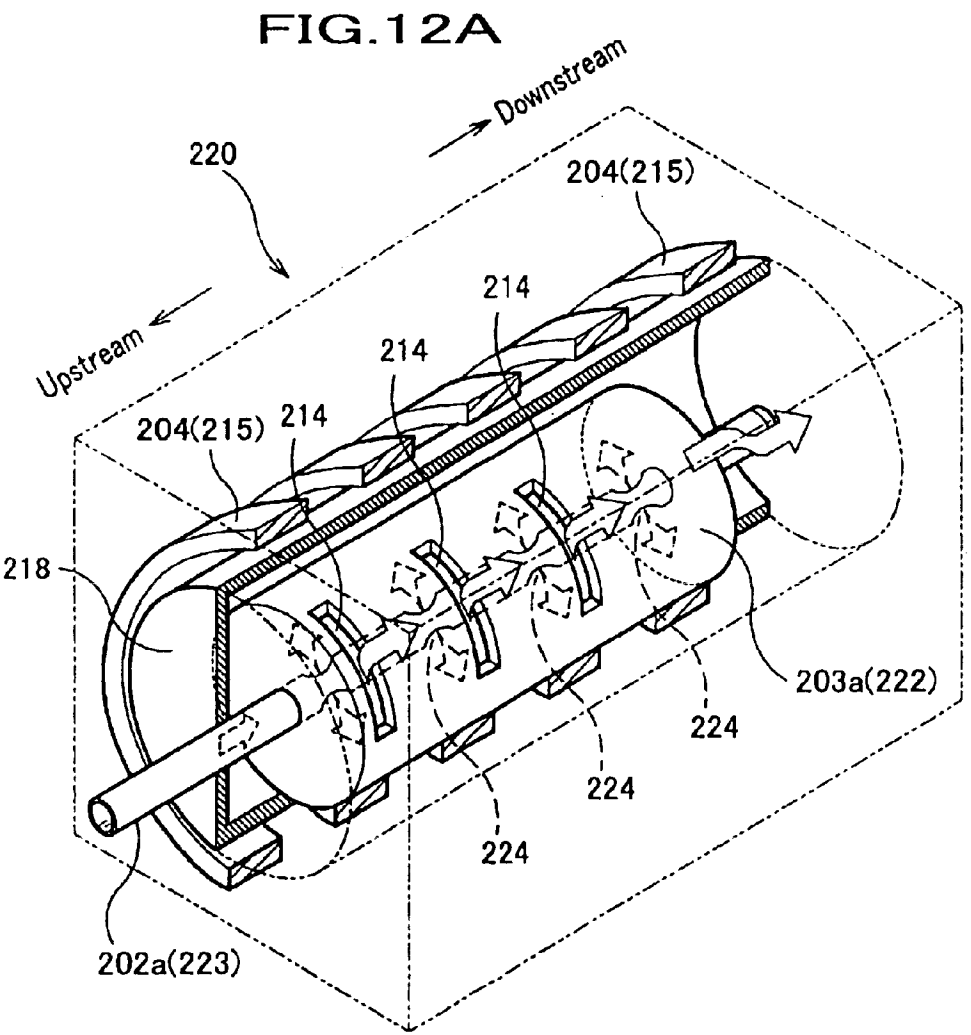

A second mode of the above-described pyrolysis means 203 and gas introduction means 202 shall now be described with reference to FIG. 12.

Parts that are in common to those of gaseous organohalogen compound decomposition treatment device 201 of the above-described second embodiment shall be provided with the same symbols and descriptions thereof shall be omitted.

A gaseous organohalogen compound decomposition treatment device 220, which is a third embodiment of this invention, comprises a gas introduction means 202*a*, pyrolysis means 203*a*, and a heating means 204 as the principal components, and is furthermore equipped with a gas exhausting means 205 (not shown) at the downstream side.

Here, the heating means 204 and gas exhausting means 205 (not shown) of this gaseous organohalogen compound decomposition treatment device 220 are the same in arrangement as those of the above-described gaseous organohalogen compound decomposition treatment device 201, and thus descriptions thereof shall be omitted. The heating unit of pyrolysis means 203*a* of the present gaseous organohalogen compound decomposition treatment device 220 is a cylinder 222, which is sealed at both ends (see FIG. 12).

Inside this cylinder 222, a circular pipe 223, which is the gas introduction means 202*a*, is passed through from one end face towards the other end face.

A plurality of exhaust holes 224 are provided on the outer circumferential surface at parts of circular pipe 223 that are positioned inside the above mentioned cylinder 222. A plurality of slits 214, which put the interior and exterior of cylinder 222 in communication, are provided on the outer circumferential surface of cylinder 222 through which circular pipe 223 is inserted. The downstream end of circular pipe 223 is sealed.

The treated gas that is supplied to this heating unit is thus supplied into the above mentioned cylinder 222 from the exhaust holes 224 provided on the outer circumferential surface of the above mentioned circular pipe 223. The treated gas that has been supplied into this cylinder 222 is then exhausted to the exterior of cylinder 222 upon passage through the slits 214 that are provided on the outer circumferential surface of cylinder 222.

Here, since cylinder 222 is heated by heating means 204, the treated gas that has been guided inside cylinder 222 is decomposed by contact with the inner wall surface of the heated cylinder 222 in the process of moving inside cylinder 222 towards the side of the above mentioned slits 214. Also, even if the treated gas does not contact the inner wall surface of cylinder 222, it is pyrolyzed by radiant heat in the process of passage through the slits 214 that are provided in cylinder 222.

Treated gas will thus not be exhausted from the slits 214 of cylinder 222 but only the decomposition gas that has been decomposed to a harmless state is exhausted and the decomposition treatment of the treated gas is thus accomplished.

Here, the diameter and material of cylinder 222 and the number and slit width of slits 214 may be determined as suited in the same manner as in the first embodiment.

Furthermore, a rifling 217 may be provided on the inner wall surface of cylinder 222 in order to perform efficient stirring of the treated gas.

Also, with regard to the positional relationship of the exhaust holes 224 provided in the above mentioned circular pipe 223 and the slits 214 provided in cylinder 222, exhaust holes 224 and slits 214 are preferably shifted with respect to each other so that the treated gas that is exhausted from the above mentioned exhaust holes 224 will not be exhausted directly from slits 214. With the present embodiment, slits 214 are provided at positions shifted by 90° with respect to exhaust holes 224 (see FIG. 12B).

Figure 13:
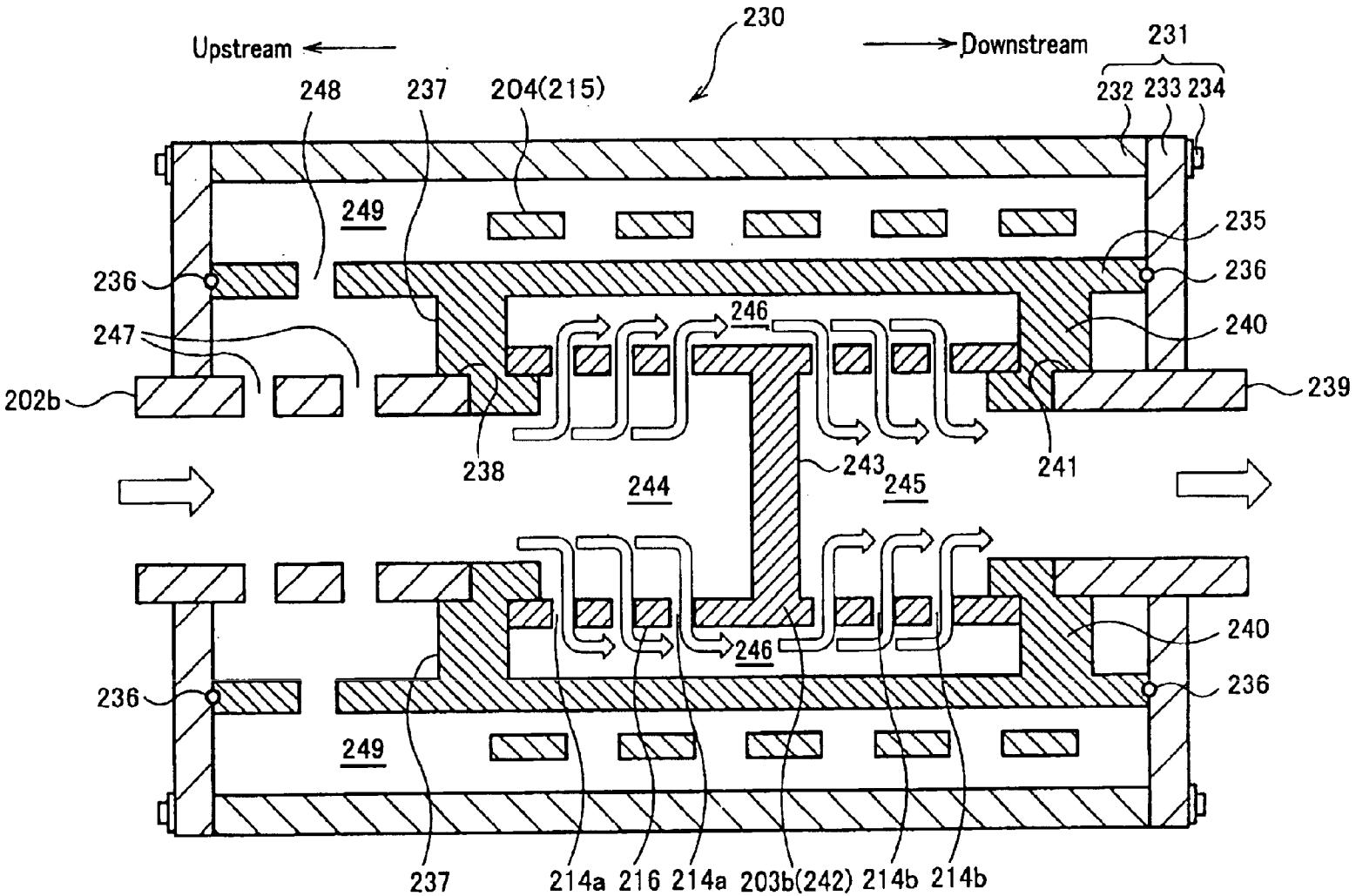
FIG. 13 is a schematic arrangement diagram of a fourth embodiment of this invention's gaseous organohalogen compound decomposition treatment device.

A fourth embodiment of the above-described pyrolysis means 203 and gas introduction means 202 shall now be described with reference to FIG. 13.

A gaseous organohalogen compound decomposition treatment device 230, which is a fourth embodiment of this invention, comprises a gas introduction means 202*b*, pyrolysis means 203*b*, and a heating means 204 as the principal components, and is furthermore equipped with a gas exhausting means 205 (not shown) at the downstream side.

Here, the heating means 204 and gas exhausting means 205 are the same in arrangement as those of the above-described gaseous organohalogen compound decomposition treatment device 201, and thus descriptions thereof shall be omitted.

The gas introduction means 202*b* and pyrolysis means 203*b* of this gaseous organohalogen compound decomposition treatment device 230 are respectively housed inside a casing 231.

This casing 231 comprises a cylindrical outer cylinder part 232 and lids 233, which are screwed onto the ends of outer cylinder part 232 by means of screws 234.

Inside this casing 231, an alumina chamber 235 with a cylindrical shape is housed in a manner whereby it is clamped by the above mentioned lids 233 via O-rings 236 that are provided at both ends.

A circular pipe 202*b*, for introducing the treated gas inside this gaseous organohalogen compound decomposition treatment device 230, is inserted into the upstream side of casing 231, and the tip of this circular pipe 202*b* is fitted into an indented part 238 of an upstream side protrusion 237 that is protruded inwards at the upstream side of the above mentioned alumina chamber 235.

Meanwhile at the downstream side of this casing 231 is inserted an exhaust pipe 239, which exhausts, from casing 231, the decomposition gas resulting from the decomposition of the treated gas, and the tip of this exhaust pipe 239 is fitted into an indented part 241 of a downstream side protrusion 240 that is protruded inwards at the downstream side of the above mentioned alumina chamber 235.

Between the upstream side protrusion 237 and downstream side protrusion 240 of the above mentioned alumina chamber 235, a cylinder 242, which is the pyrolysis means 203*b*, is clamped by the upstream side protrusion 237 and downstream side protrusion 240. Inside this cylinder 242 is provided a partition wall 243, which partitions the space inside this cylinder 242 into an upstream side hollow part 244 and a downstream side hollow part 245.

Slits 214*a* and slits 214*b*, which put the interior and exterior of cylinder 242 in communication, are provided in plurality on the outer peripheral surfaces of cylinder 242 at positions corresponding to upstream side hollow part 244 and downstream side hollow part 245, respectively.

A communicating space 246, which puts the above mentioned upstream side hollow part 244 and the downstream side hollow part 245 in communication, is formed between the part surrounded by the upstream side protrusion 237 and downstream side protrusion 240 of the above mentioned alumina chamber 235 and the outer peripheral surface of cylinder 242.

Here, cylinder 242 is induction heated by a high-frequency coil 215 of the above mentioned heating means 204 and a flow of gas from the upstream side to the downstream side of cylinder 242 is caused by the gas exhausting means 205 (not shown).

The treated gas, which has been introduced inside this gaseous organohalogen compound decomposition treatment device 230 through circular pipe 202*b*, is first subject to contact pyrolysis by contact with the inner wall of upstream side hollow part 244 and partition wall 243 of cylinder 242 and is then pyrolyzed by radiant heat in the process of being guided into communicating space 246 upon passage through the slits 214*a* provided at the upstream side hollow part 244.

The treated gas is then passed from the interior of communicating space 246, through slits 214*b*, and into the downstream side hollow part 245.

Thus even if undecomposed treated gas is contained in the gas that is guided from the above mentioned upstream side hollow part 244 into this communicating space 246, this undecomposed treated gas will have the opportunity of being subject again to pyrolysis by radiant heat and contact pyrolysis by contact with the inner wall surface of downstream side hollow part 245.

As a result, the gas resulting from the gasification of halogen compounds is decomposed into harmless decomposition gas without fail.

At the outer circumferential surface parts of the above-described guiding pipe 202*b* at positions housed inside the above mentioned alumina chamber 235 are provided communicating holes 247 for putting the interior and exterior of guide pipe 202*b* in communication. Furthermore, exhaust holes 248, which put the interior and exterior of the above mentioned alumina chamber 235 in communication, are provided at the upstream side of alumina chamber 235.

Thus when a flow of gas from the upstream side to the downstream side of this gaseous organohalogen compound decomposition treatment device 230 is caused by operation of a vacuum pump (not shown) of a pressure reducing means 4 that is positioned at the downstream side of gaseous organohalogen compound decomposition treatment device 230, the gas inside a space 249 between the outer circumferential surface of alumina chamber 235 and housing 231 is sucked in and the interior of space 249 is kept under a reduced pressure atmosphere.

Since high-frequency coil 215 of heating means 204 is housed inside this space 249, the maintaining of the interior of this space 249 under a reduced pressure atmosphere leads to the prevention of the degradation of the high-frequency coil 215 by oxidation.

Also, since the interior of space 249 is kept under a reduced pressure atmosphere, the heat that is applied to the above mentioned pyrolysis means 203*b* that is heated by high-frequency coil 215 will also not be emitted to the exterior of casing 231 by heat transfer. All heat can thus be used to heat cylinder 242 of the above-described pyrolysis means 203*b* without giving rise to heat loss.

Figure 14:
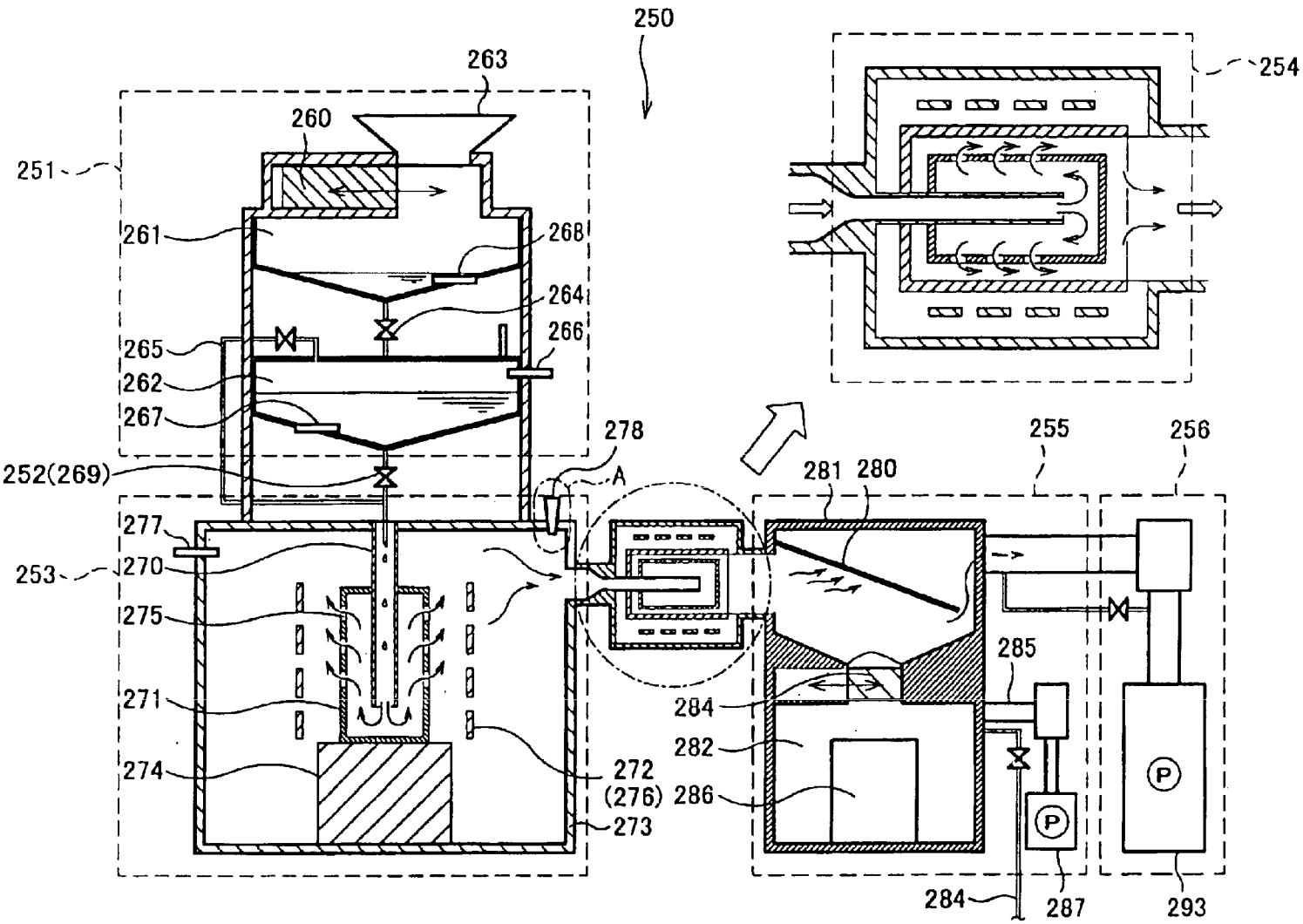
FIG. 14 is a schematic explanatory diagram of this invention's liquid organohalogen compound decomposition treatment device.

A liquid organohalogen compound decomposition treatment device 250, which applies this invention's gaseous organohalogen compound decomposition treatment device shall now be described. FIG. 14 is a schematic arrangement diagram of liquid organohalogen compound decomposition treatment device 250, which applies this invention's gaseous organohalogen compound decomposition treatment device.

This liquid organohalogen compound decomposition treatment device 250 comprises a storage means 251, discharge means 252, gasifying means 253, decomposition treatment means 254, trapping means 255, and pressure reducing means 256 as the principal components.

The storage means 251 of this liquid organohalogen compound decomposition treatment device 250 stores liquid PCBs.

This storage means 251 comprises a slide gate valve 260, a first storage tank 261, and a second storage tank 262.

The slide gate valve 260 of this storage means 251 is interposed between the above mentioned first storage tank 261 and a funnel-shaped loading entrance 263, and after the loading of liquid PCBs into first storage tank 261 has been completed, slide gate valve 260 is closed to prevent the mixing of excess air into first storage tank 261.

First storage tank 261 is disposed at the lower side of the above mentioned slide gate valve 260 and stores the liquid PCBs that have been loaded via the above mentioned slide gate valve 260.

Second storage tank 262 is disposed at the lower side of the above mentioned first storage tank 261 with a supply valve 264 provided in between and stores the liquid PCBs discharged from the above mentioned first storage tank 261 under a reduced pressure atmosphere.

The reduced pressure atmosphere inside this second storage tank 262 is formed by a vacuum pump 293, of the below-described pressure reducing means 256, that exhausts the air, which has been guided into second storage tank 262 along with the liquid PCBs in the process of supplying the liquid PCBs, via an evacuation piping 265 provided at an upper part of second storage tank 262.

Also, the opening and closing of the supply valve 264 interposed between first storage tank 261 and second storage tank 262 is performed as suited based on detection results obtained by detection of the amount of liquid PCBs stored in second storage tank 262 by means of upper limit liquid level sensor 266 and lower limit liquid level sensor 267 provided inside second storage tank 262.

Likewise, the opening and closing of the above mentioned slide gate valve 260 is performed as suited based on the detection result of a liquid level sensor 268 provided inside the above mentioned first storage tank 261.

Storage means 251 thus prevents the lowering of the degree of reduced pressure inside the liquid organohalogen compound decomposition treatment device 250 due to the mixing in of air into the downstream side of storage means 251 (the parts from gasifying means 253 to trapping means 255) in the process of decomposition treatment of liquid PCBs. That is, a structure with which the atmospheric system and a reduced pressure system are sealed by a liquid is formed.

The discharge means 252 of this liquid organohalogen compound decomposition treatment device 250 supplies a predetermined amount at a time of the liquid PCBs stored in second storage tank 262 of the above-described storage means 251 into a liquid supply pipe 270 of the gasifying means 253 to be described later.

Here with the present embodiment, a needle valve 269 is used as this discharge means 252.

With this needle valve 269, the degree of opening of needle valve 269 is determined based on the measurement value, etc., of a pressure sensor 277, provided inside a treatment chamber 273 of the below-described gasifying means 253, to drip the liquid PCBs into liquid supply pipe 270 of the below-described gasifying means 253 at a predetermined rate and amount.

Thus by the existence of this discharge means 252, an amount of liquid PCBs that is optimal for the gasification of liquid PCBs inside the below-described gasifying means 253 is supplied at all times.

The gasifying means 253 of this liquid organohalogen compound decomposition treatment device 250 is a device that heats the liquid PCBs that are supplied via the above-described discharge means 252 from within the above-described storage means 251 and thereby gasifies the liquid PCBs to gaseous PCBs (see FIG. 11).

This gasifying means 253 comprises a liquid supply pipe 270, gasification cylinder 271, heating part 272, and treatment chamber 273.

The liquid supply pipe 270 of gasifying means 253 introduces the liquid PCBs, which have been discharged from the above-described storage means 251 by the above-described discharge means 252, into gasification cylinder 271 of gasifying means 253.

With the present embodiment, a circular pipe is used as this liquid supply pipe 270 and the upper end of liquid supply pipe 270 is connected to the discharge port (not shown) of the above-described discharge means 252, the lower end is inserted into gasification cylinder 271, and the tip of this liquid supply pipe 270 extends to the lower part of the interior of gasification cylinder 271.

In order to prevent detachment from the above-described discharge means 252 due to expansion and shrinkage by heating and cooling and to prevent breakage of liquid supply pipe 270, liquid supply pipe 270 is arranged from alumina, which is excellent in heat resistant and low in expansion and shrinkage due to heat.

This liquid supply pipe 270 is constantly heated to a high temperature by the heating part 272 to be described later and is constantly placed under a reduced pressure atmosphere by the operation of vacuum pump 293, which is the below-described pressure reducing means 256 of this liquid organohalogen compound decomposition treatment device 250.

The liquid PCBs that has been dripped or sprayed into liquid supply pipe 270 is heated in the process of falling freely from the upper part to lower part of the interior of liquid supply pipe 270 and most of the liquid PCBs is thus converted to gaseous PCBs.

Since the air inside treatment chamber 273, in which liquid supply pipe 270 is housed, is constantly drawn by vacuum pump 293 of the below-described pressure reducing means 256, the gaseous PCBs and liquid PCBs are sucked out towards the inner side of gasifying cylinder 271 into which liquid supply pipe 270 is inserted.

This gasifying cylinder 271 of gasifying means 253 exposes the liquid PCBs and gaseous PCBs supplied via the above-described liquid supply pipe 270 to a heated environment and thereby gasifies all of the PCBs to gaseous PCBs.

This gasifying cylinder 271 has the shape of a cylinder with both ends closed and the above-described liquid supply pipe 270 is inserted from the one end side at the upper side (see FIG. 11).

This gasifying cylinder 271 is set on the upper surface of an alumina pedestal 274, which is disposed inside the treatment chamber 273 that houses gasifying cylinder 271, and on the outer peripheral surface of gasifying cylinder 271, a plurality of slits 275, which put the interior and exterior of gasifying cylinder 271 in communication, are provided along the circumferential direction from the central part to upper part of gasifying cylinder 271.

As with the above-described liquid supply pipe 270, gasifying cylinder 271 is also heated by the heating part 272 to be described later. The gaseous PCBs that have been sucked out from the above-described liquid supply pipe 270 are thus decomposed by heat upon contact with the inner wall surface of gasifying pipe 271. Meanwhile, even if gaseous PCBs are guided to slits 275 without contacting the inner wall surface of the gasifying part, the gaseous PCBs will be decomposed by heat in the process of passage through the slits 275.

However, since the present embodiment is arranged to gasify liquid PCBs at the above-described liquid supply pipe 270 and gasifying cylinder 271, the heat inside liquid supply pipe 270 and gasifying pipe 271 is taken up when the liquid PCBs are gasified.

The existence of gaseous PCBs that are lead to the downstream side of gasifying means 253 without being decomposed inside gasifying cylinder 271 may thus be of concern. Thus with this embodiment's liquid organohalogen compound decomposition treatment device 250, the above-described gaseous organohalogen compound decomposition treatment device 201 is disposed as the decomposition treatment means 254 at the downstream side of gasifying means 253 in order to assure complete decomposition treatment of the gaseous PCBs.

The heating part 272 of gasifying means 253 heats liquid supply pipe 270 and gasifying cylinder 271.

Heating part 272 comprises a high-frequency coil 276. This high-frequency coil 276 is disposed at a position separated from the outer circumferential surfaces of the above-described liquid supply pipe 270 and gasifying cylinder 271 in a manner whereby it spirals downward from the upper side. High-frequency coil 276 is connected to an unillustrated high-frequency power supply and heats gasifying cylinder 271 and liquid supply pipe 270 as suited to a desired temperature.

The treatment chamber 273 of gasifying means 253 houses liquid supply pipe 270, gasifying cylinder 271, and heating part 272. The interior of this treatment chamber 273 is maintained constantly under a reduced pressure atmosphere by vacuum pump 293 of the below-described pressure reducing means 256.

Treatment chamber 273 is equipped with a pressure sensor 277, which measures the pressure inside treatment chamber 273, and a rupture disc 300, which functions as a pressure release valve 278.

This pressure release valve 278 opens to release the pressure inside treatment chamber 273 when a large amount of gas that exceeds the evacuation capacity of vacuum pump 293 of the below-described pressure reducing means 256 is generated in treatment chamber 273 and the interior of treatment chamber 273 is put in a pressurized state.

Figure 16A:
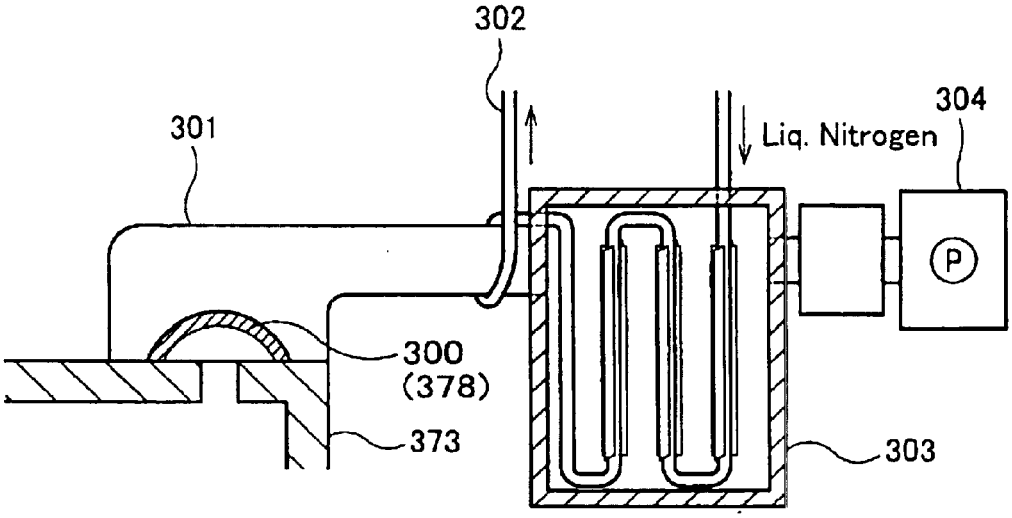
FIG. 16 shows schematic explanatory diagrams of a pressure release valve and a trap provided in a treatment chamber of this invention's liquid organohalogen compound decomposition treatment device.
Figure 16B:
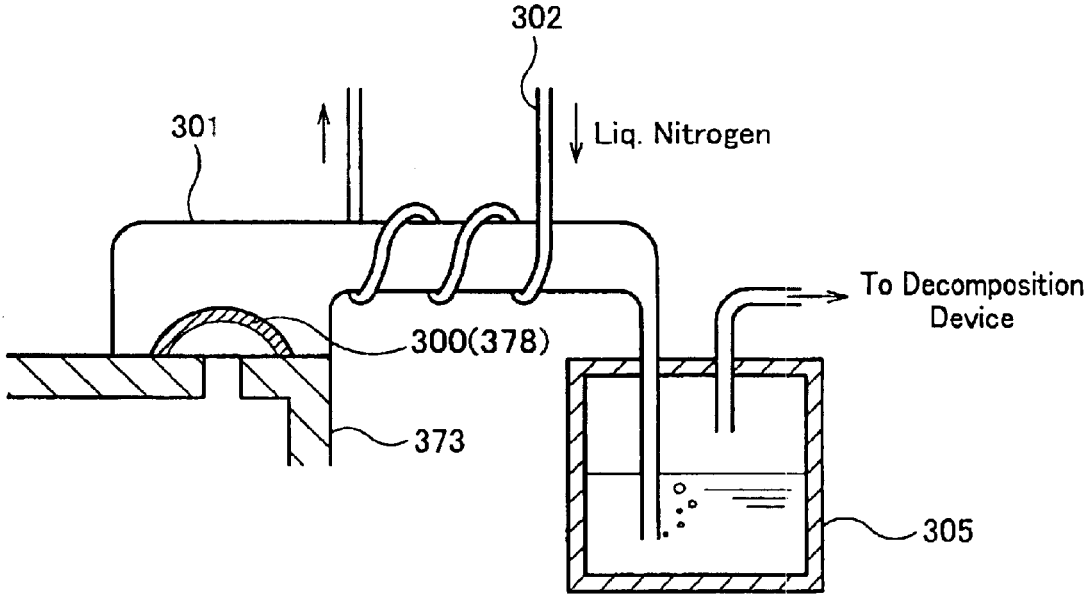

When the pressure inside treatment chamber 273 is released by pressure release valve 278, the gaseous PCBs inside treatment chamber 273 will be released into the atmosphere. Thus in order to prevent the release of PCBs into the atmosphere, a trap 303, which is shown in FIG. 16, is preferably provided.

This trap device is connected via a piping 301 to the above-described treatment chamber 273 and a vacuum pump 304, which creates a reduced pressure environment inside the trap via a valve, is provided at the downstream side of the trap.

Since the interior of trap 303 is constantly maintained in a reduced pressure state by vacuum pump 304, when the pressure release valve 278 of the above-described treatment chamber 273 is opened, pressure is absorbed within the space extending from piping 301 to trap 303.

A cooling pipe 302, through which liquid nitrogen or other suitable coolant is passed through, is provided inside trap 303 and on the outer peripheral surface of piping 301. This cooling pipe 302 is disposed in a meandering manner inside trap 303 and is provided with fins, for efficient cooling of the interior of trap 303, on the outer peripheral surface of the part of cooling pipe 302 that is positioned inside trap 303.

Thus by passing a coolant through cooling pipe 302, the high-temperature gas that is discharged from within the above-described treatment chamber 273 is cooled rapidly and the volume of the gas is reduced. As a result, the breakage of trap 303 and piping 301 is prevented and the discharge of PCBs outside the device is prevented.

The decomposition treatment means 254 of liquid organohalogen compound decomposition treatment device 250 is connected to the downstream side of treatment chamber 273 of the above-described gasifying means 253 and pyrolyzes the gasified gas of PCBs that is discharged from the aforementioned treatment chamber.

This treatment means 54 is the same in arrangement as the above-described gaseous organohalogen compound decomposition treatment device 201 and a description thereof shall thereof be omitted here.

The trapping means 255 of this liquid organohalogen compound decomposition treatment device 250 recovers the decomposition products contained in the decomposition gas resulting from the decomposition of gaseous PCBs in the above-described decomposition treatment means 254.

This trapping means 255 is connected to the downstream side of the above-described decomposition treatment means 254 and comprises an upper chamber 281, which is equipped with a cooling plate 280, and a lower chamber 282, which is connected via a gate valve 283 to the lower side of upper chamber 281.

The cooling plate 280 provided at upper chamber 281 is arranged from nickel alloy and adsorbs the high-temperature decomposition gas, which has been guided into trapping means 255, as carbon content using the catalytic reaction of nickel and prevents the high-temperature decomposition gas from being supplied directly into pressure reducing means 256, which is disposed at the downstream side of this trapping means 255.

The above-described cooling plate 280 is connected to an unillustrated cooling pipe and is constantly cooled to a low temperature by liquid nitrogen or other coolant that is passed through this cooling pipe. The high-temperature decomposition gas that is discharged from the decomposition treatment means 254 upstream the trapping means 255 is thereby cooled rapidly to promote the adsorption of decomposition products in the decomposition gas.

The method of configuring this cooling plate 280 is not restricted in particular as long as the configuration is such that the atmosphere inside upper chamber 281 will be guided to pressure reducing means 256 at the downstream side after passing through the gap between cooling plate 280 and upper chamber 281.

Lower chamber 282 is a device for recovering the decomposition products that have been adsorbed and trapped within upper chamber 281. An inert gas cylinder (not shown) for replacing the interior of lower chamber 282 with argon or other inert gas and a vacuum pump 287 are thus connected via inert gas supply piping 284 and evacuation piping 285 to the interior of lower chamber 282.

Thus by closing the gate valve 283, which partitions lower chamber 282 and upper chamber 281 and then supplying inert gas via the inert gas supply piping 284 that is connected to lower chamber 282 to bring the pressure inside lower chamber 282 to atmospheric pressure, carbon and other decomposition products that have been stored in lower chamber 282 can be recovered from carbon powder take-out exit 286.

Then after removing the carbon powder from lower chamber 282 and then bringing the interior of lower chamber 282 back to a reduced pressure atmosphere by means of the vacuum pump 287 that is connected to lower chamber 282, the above mentioned gate valve 283 is opened to put lower chamber 282 into communication with the above-described upper chamber 281 to enable carbon and other decomposition products to be stored in lower chamber 282 again.

The work of removing the carbon powder, etc., can thus be performed without stopping this invention's liquid organohalogen compound decomposition treatment device 250.

Figure 15:
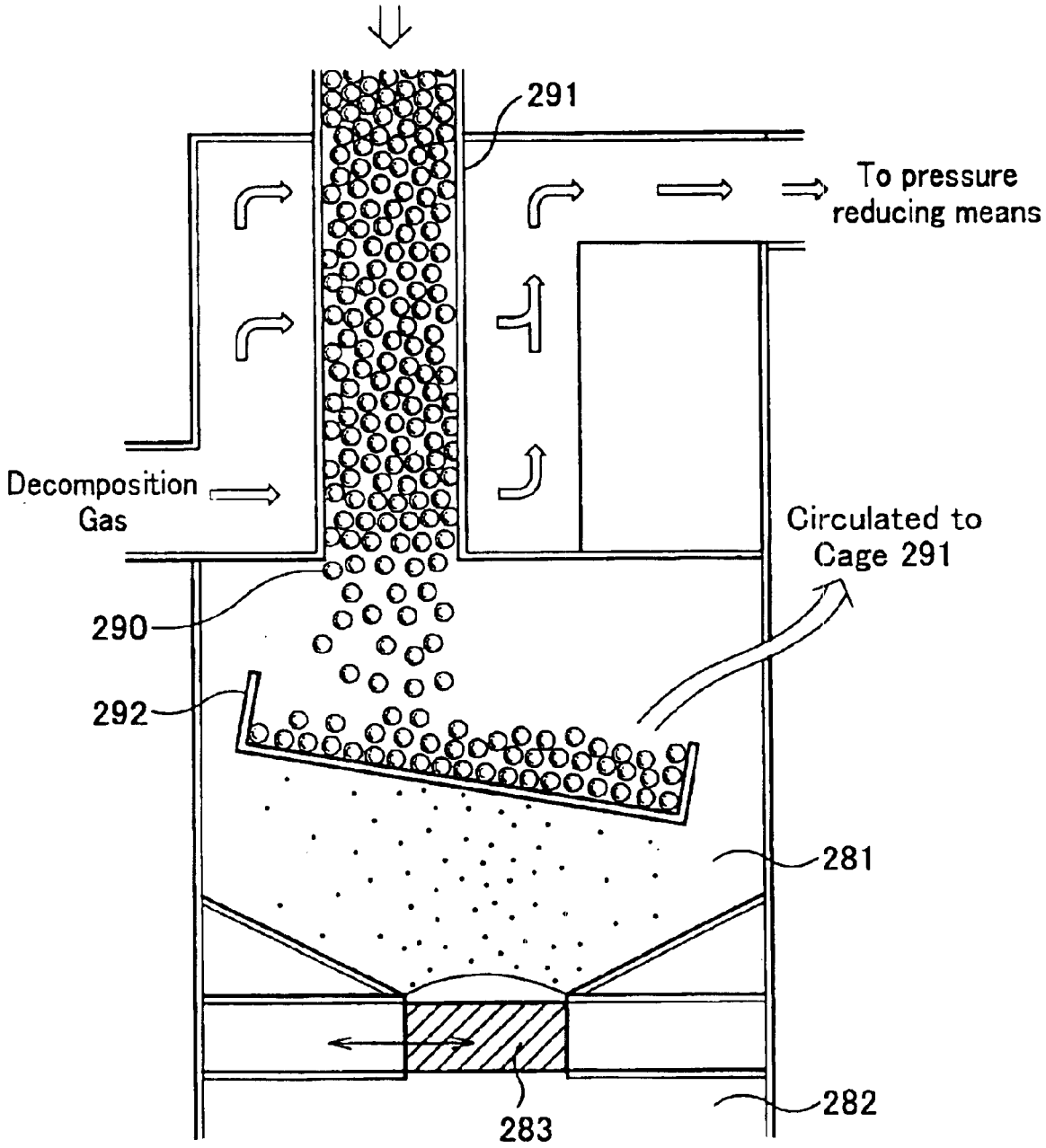
FIG. 15 is a diagram of an embodiment of a trapping device of this invention's liquid organohalogen compound decomposition treatment device.

Also in place of the above-described cooling plate 280, a cage 291, filled with nickel balls 290, may be provided and the decomposition gas that is discharged from the above-described decomposition treatment means 254 may be passed through the interior of this cage 291 and then discharged from the downstream side of this trapping means 255 (see FIG. 15).

With this embodiment, nickel balls 290, which have been cooled by a suitable cooling means, are arranged to be dropped intermittently downwards from the upper side of cage 291. In this case, the decomposition gas that passes through cage 291 becomes attached to the surfaces of nickel balls 290 as carbon, etc., by the catalytic action of nickel.

And by the shaking by a vibrating screen 292, disposed at the lower side of cage 291, the carbon, etc., that have become attached to the surfaces of nickel balls 290 are removed and recovered inside the above-described lower chamber 282.

The nickel balls 290 from which carbon, etc., have been removed are circulated and supplied again to cage 291.

The pressure reducing means 256 of this invention's liquid organohalogen compound decomposition treatment device 250 forcibly discharges the atmosphere inside second storage tank 262 of the above-described storage means 251, treatment chamber 273 of the above-described gasifying means 253, and the above-described trapping means 255 out of the device and forms a reduced pressure atmosphere inside this invention's liquid organohalogen compound decomposition treatment device 250.

With the present embodiment, a vacuum pump 293 is used as this pressure reducing means 256. As with the above-described gaseous organohalogen compound decomposition treatment device 201, a vacuum pump that is generally used in the present field is used as vacuum pump 293.

Figure 17:
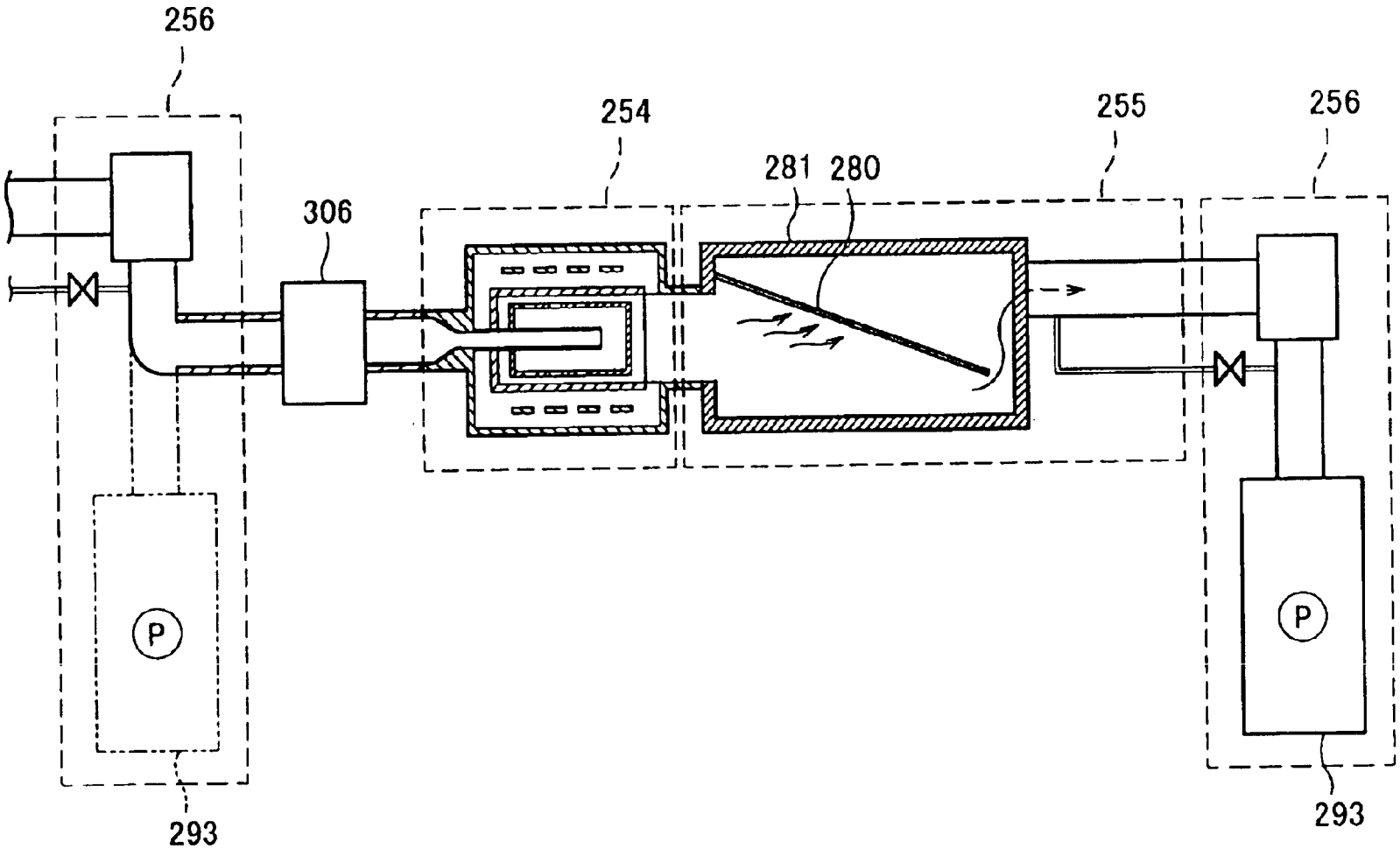
FIG. 17 is a schematic explanatory diagram of a safety device provided at the pressure reducing means side of this invention's liquid organohalogen compound decomposition treatment device.

As shown in FIG. 17, an arrangement is also possible wherein the decomposition treatment means 254, trapping means 255, and pressure reducing means 256 are connected further via the piping of this pressure reducing means 256 as shown in FIG. 17.

By this arrangement, when a problem occurs at any part between gasifying means 253 and trapping means of liquid organohalogen compound decomposition treatment device 250, the undecomposed PCB's that resides at the part between gasifying means 253 and trapping means 255 can be rendered harmless.

<Operation>

The operation of this invention's liquid organohalogen compound decomposition treatment device 250 shall now be described.

First, the slide gate valve 260 of the above-described storage means 251 is opened to load liquid organohalogen compounds into first storage tank 261, and after completion of loading, slide gate valve 260 is closed.

Subsequently, supply valve 264 is opened to transfer the liquid organohalogen compounds inside the above-described first storage tank 261 to second storage tank 262. The valve 279 of the evacuation piping 265 that is connected to the upper face of this second storage tank 262 is opened and the air inside second storage tank 262 is discharged by vacuum pump 293 to form a reduced pressure atmosphere inside second storage tank 262.

The needle valve 279, mounted to the lower side of second storage tank 262, is opened and the liquid organohalogen compounds stored inside second storage tank 262 are dripped into liquid supply pipe 270 of gasifying means 253.

The liquid organohalogen compounds that are dripped into liquid supply pipe 270 are heated and gasified as they drop through the interior of liquid supply pipe 270 and most of the compounds are converted to gaseous organohalogen compounds.

The liquid organohalogen compounds that are not gasified inside liquid supply pipe 270 are heated and gasified completely inside the gasifying cylinder 271 in which the tip part of liquid supply pipe 270 is housed.

The gaseous organohalogen compounds that were generated inside this gasifying means 253 are drawn out towards the decomposition treatment means 254 at the downstream side by vacuum pump 293 of pressure reducing means 256 and then passed through the interior of circular pipe 210 of decomposition treatment means 254 and guided to cylinder 212 (see FIGS. 11 through 14).

The gaseous organohalogen compounds that have been guided into cylinder 212 are guided to the slits 214 provided on the outer circumferential surface of cylinder 212 while being stirred in spiraling manner by rifling 217 inside cylinder 212.

In this process, the gaseous organohalogen compounds that contact the inner wall surface of cylinder 212 are contact pyrolyzed by heat and converted into decomposition gas. The gaseous organohalogen compounds that did not make contact are decomposed to decomposition gas by radiant heat in the process of passage through slits 214.

When the decomposition gas that is then guided to the trapping means 255, positioned downstream the decomposition treatment means 254, contacts the cooled nickel cooling plate 280 inside trapping means 255, the decomposition gas becomes adsorbed and recovered as soot on cooling plate 280 due to the catalytic action of nickel.

(Fifth Embodiment)

An embodiment of an organohalogen compound pyrolysis treatment device by this invention shall now be described with reference to the attached drawings.

As shown in FIG. 18, an organohalogen compound pyrolysis treatment device 401 by this invention comprises an introduction part 402, into which dioxin-containing gas is introduced, a pyrolysis part 403, which pyrolyzes the dioxin-containing gas that has been introduced into the above mentioned introduction part 402, a discharge part 404, which discharges the pyrolysis gas resulting from the decomposition at the above mentioned pyrolysis part 403, and an induction heating coil 405, which surrounds the main body 403*a* of the above mentioned pyrolysis part 403 from the exterior and heats a heating unit 403*f* in the interior, as the principal components.

Introduction part 402 comprises a dioxin-containing gas introduction entrance 402*a* and a duct 402*b*, which becomes enlarged in diameter from the upstream side to the downstream side, as the principal components.

A water-cooled type cooling jacket 402*c* for cooling introduction part 402 is provided at the outer circumference of duct 402*b*.

A flange 402*d* is provided at the large-diameter end of duct 402*b* and is joined by a plurality of sets of bolts B and nuts N to a flange 403*b* provided at an end of the below-described pyrolysis part 403.

Figure 19:
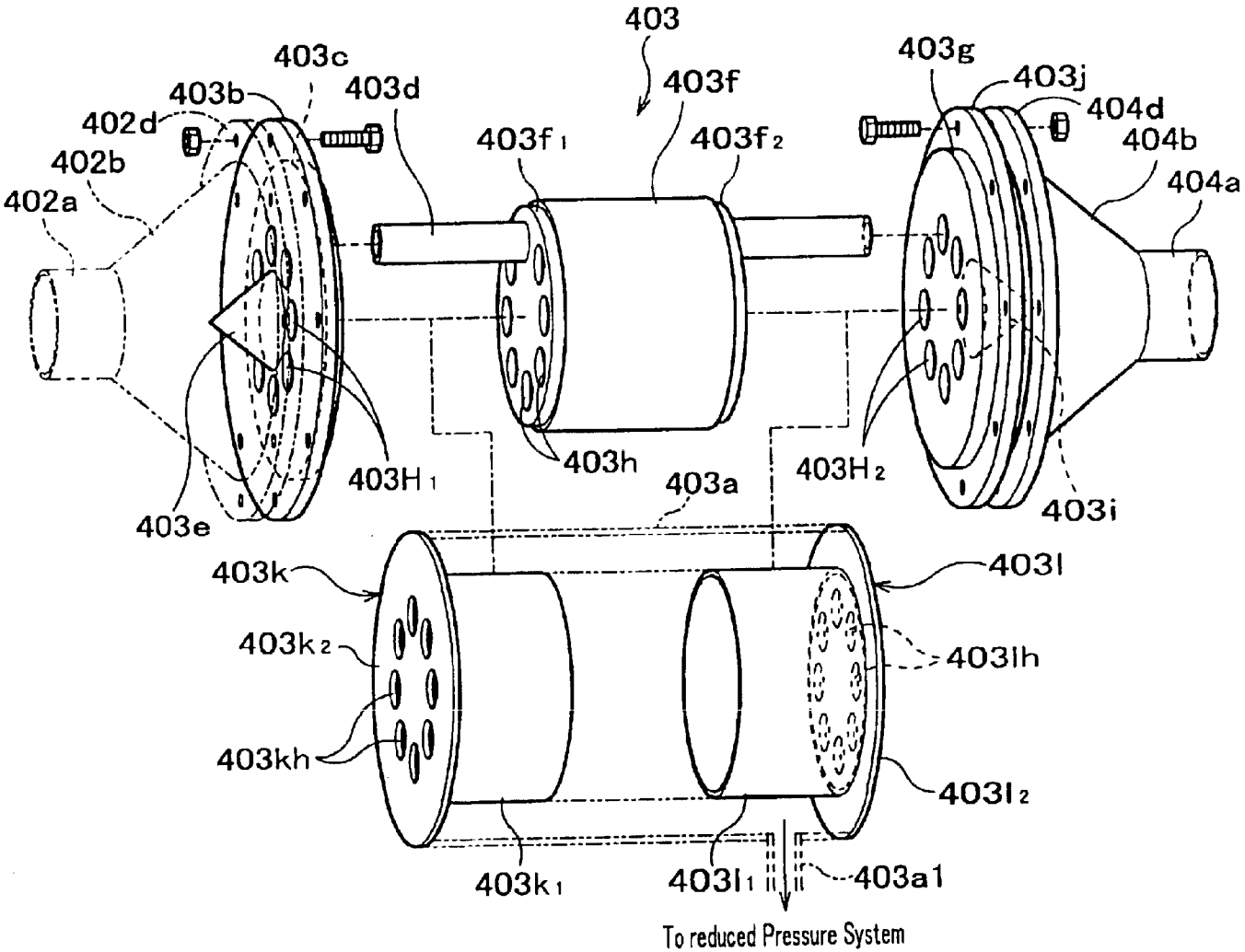
FIG. 19 is a perspective view, showing the internal structure of this invention's organohalogen compound pyrolysis device.

At the interior of duct 402*b* is provided a guide member 403*e*, which, as shown in FIG. 19, protrudes towards the upstream side from the central part of a pipe supporting plate 403*c* of pyrolysis part 403 to enable the dioxin-containing gas to be introduced readily into ceramic pipes 403*d*. Though guide member 403*e* has a conical shape in the present embodiment, other embodiments shall be described later.

As shown in FIG. 19, pyrolysis part 403 mainly comprises a cylindrical main body 403*a*, a heating unit 403*f*, which is disposed substantially at the center of the interior of the above mentioned main body 403*a* and has eight through holes 403*h* that are positioned in the radial direction and along the inner side of the outer circumference, a plurality of ceramic pipes 403*d*, which are inserted through the eight through holes 403*h* of the above mentioned heating unit 403*f*, pipe supporting plates 403*c* and 403*g*, which respectively support the respective ends of the above mentioned ceramic pipes 403*d*, and spacers 403*k* and 403*l*, which are for positioning the above mentioned heating unit 403*f* in the above mentioned pyrolysis part 403.

Main body 403*a* is a cylindrical container made of alumina. As shown in FIG. 18, at the outer circumferential surface of main body 403*a*, induction heating coil 405 for heating the heating unit 403*f* is provided in a surrounding manner.

Though with the present embodiment, alumina is used as the material of main body 403*a*, a non-dielectric ceramic, such as silica and SiC, may be used as a material besides alumina.

To the main body 403*a* of the present embodiment is mounted a single nozzle 403*al* for connecting the interior of main body 403*a* via a piping to a pressure reducing means, for example, a vacuum pump (see FIGS. 18 and 19).

By thus arranging main body 403*a* to be connected to a pressure reducing means, the interior of main body 403*a* can be reduced in pressure by means of the pressure reducing means to lessen the amount of oxygen in the air in the process of performing induction heating of the heating unit, and since the amount of consumption of the carbon or other combusting component that makes up heating unit 403*f* can thus be lessened, the life of heating unit 403*a f* can be elongated.

As another method, another single nozzle 403*al* may be provided separately, the two nozzles may be used as an entrance and exit, respectively, for a gas, nozzle 403*al* may be connected to an inert gas pressurizing means, for example, a gas cylinder, and induction heating may be performed after replacing the interior of main body 403*a* with inert gas. Since there will thus be no oxygen in the air, the life of heating unit 403*a f* can be elongated.

With regard to the inert gas, since nitrogen and carbon dioxide produce nitrogen compounds and carbon compounds with ceramic materials at high temperatures, replacement by argon gas or helium gas is preferable.

As the material of heating unit 403*a f*, clay carbon, with the same cylindrical shape as a briquette, is used in the present embodiment as shown in FIG. 19. Heating unit 403*a f* is provided with eight through holes 403*h* that are positioned in the radial direction and along the inner side of the outer circumference.

By providing eight through holes 403*h* in the radial direction and along the inner side of the outer circumference of the heating unit, since heating unit 403*a f* is heated from the outer side to the inner side when heating unit 403*a f* is induction heated, the dioxin-containing gas can be made to flow immediately through the eight through holes 403*h*.

Though a material, such as a dielectric ceramic, etc., may be used as the material of heating unit 403*a f*, the use of a carbon material, such as graphite, etc., is more preferable in that the rate of temperature rise in the heating process can be made high.

Though besides a cylindrical shape, a quadratic prism shape may be used as the shape of heating unit 403*a f*, the electric current will concentrate at the corner parts and the temperature distribution will tend to be non-uniform with a quadratic prism.

A non-dielectric material, for example, a circular pipe of alumina is used as ceramic pipe 403*d*. Silicon carbide can also be given as a material that may be used besides alumina.

Ceramic pipes 403*d* are inserted through the eight through holes 403*h* provided in heating unit 403*a f* and the ends at both sides are supported by through holes 403$H_1$ and 403$H_2$ of the two pipe supporting plates 403*c* and 403*g*. Also, by reducing the cross-sectional area of the gas flow path inside duct 402*b* by means of guide member 403*e* and making the flow rate higher, the clogging of the interiors of ceramic pipes 403*d* by uncombusted carbon and other solids can be prevented even if such solids are contained in the dioxin-containing gas.

Pipe supporting plates 403*c* and 403*g* are disk-shaped plates made of a metal, such as alumina, and respectively have eight through holes 403$H_1$ and 403$H_2$ formed in the radial direction and along the inner sides of the outer circumferences. Guide member 403*e* and 403*i*, which distribute and guide the dioxin-containing gas into the respective ceramic pipes 403*d* are provided as conical protrusions at the central parts of pipe supporting plates 403*c* and 403*g*, respectively.

By providing such conical protrusions and varying the cross-sectional area of the flow path, the introduction and discharge of the dioxin-containing gas and pyrolysis gas can be performed favorably inside ducts 402*b* and 404*b*.

With regard to the mounting position, guide member 403*i* is mounted at the upstream side of pipe supporting plate 403*c* at introduction part 402 and is mounted to the downstream side of pipe supporting plate 403*g* at discharge part 404. The guide member 403*i* at the discharge part 404 side may be omitted.

Spacers 403*k* and 403*l* comprise cylindrical pipes 403$k_1$ and 403$l_1$, respectively, which are cylindrical members, and flanges 403$k_2$ *and* 403$l_2$, respectively, and the open end parts of the above mentioned pipes 403$k_1$ and 403$l_1$ are formed so that the inner surfaces of the open end parts fit in a detachable manner with step parts 403*a* $f_1$ and 403*a* $f_2$ provided at both ends of the above-described heating unit 403*a f* to thereby enable supporting of the heating unit 403*a f* at the fitted parts.

Each of flanges 403$k_1$, and 403$l_1$, is provided with eight through holes (403*kh*), (403*lh*) for insertion of the ceramic pipes.

By supporting both ends of heating unit 403*a f* by the two spacers 403*k* and 403*l* at both sides, the position of heating unit 403*a f* in pyrolysis part 403 can be fixed substantially at the center of main body 403*a* at all times. As a result, the position to be heated by induction heating coil 405 can always be set to the central part of heating unit 403*a f*, and the temperature inside ceramic pipes 403*d* will thus be prevented from varying greatly due to the shifting of the position at which heating unit 403*a f* is heated.

With the present embodiment, a non-dielectric material, such as aluminum, is used as the material of spacers 403*k* and 403*l*.

Discharge part 404 mainly comprises a dioxin pyrolysis gas discharge port 404*a* and a duct 404*b*, which decreases in diameter from the upstream side to the downstream side.

As with introduction part 402, a water-cooled type cooling jacket 404*c* for cooling the duct 404*b* is provided on the outer circumference of duct 404*b* as shown in FIG. 18.

A flange 4*d* is provided at the large-diameter end of duct 404*b* and is joined by bolts B and nuts N to a flange 3*j* provided at an end of pyrolysis part 403.

At the interior of duct 404*b* is provided a guide member 403*i*, which protrudes towards the downstream side from the central part of pipe supporting plate 403*g* of pyrolysis part 403 to enable the pyrolysis gas, resulting from the pyrolysis of the dioxin-containing gas at pyrolysis part 403, to be discharged readily from ceramic pipes 403*d*.

Figure 20:
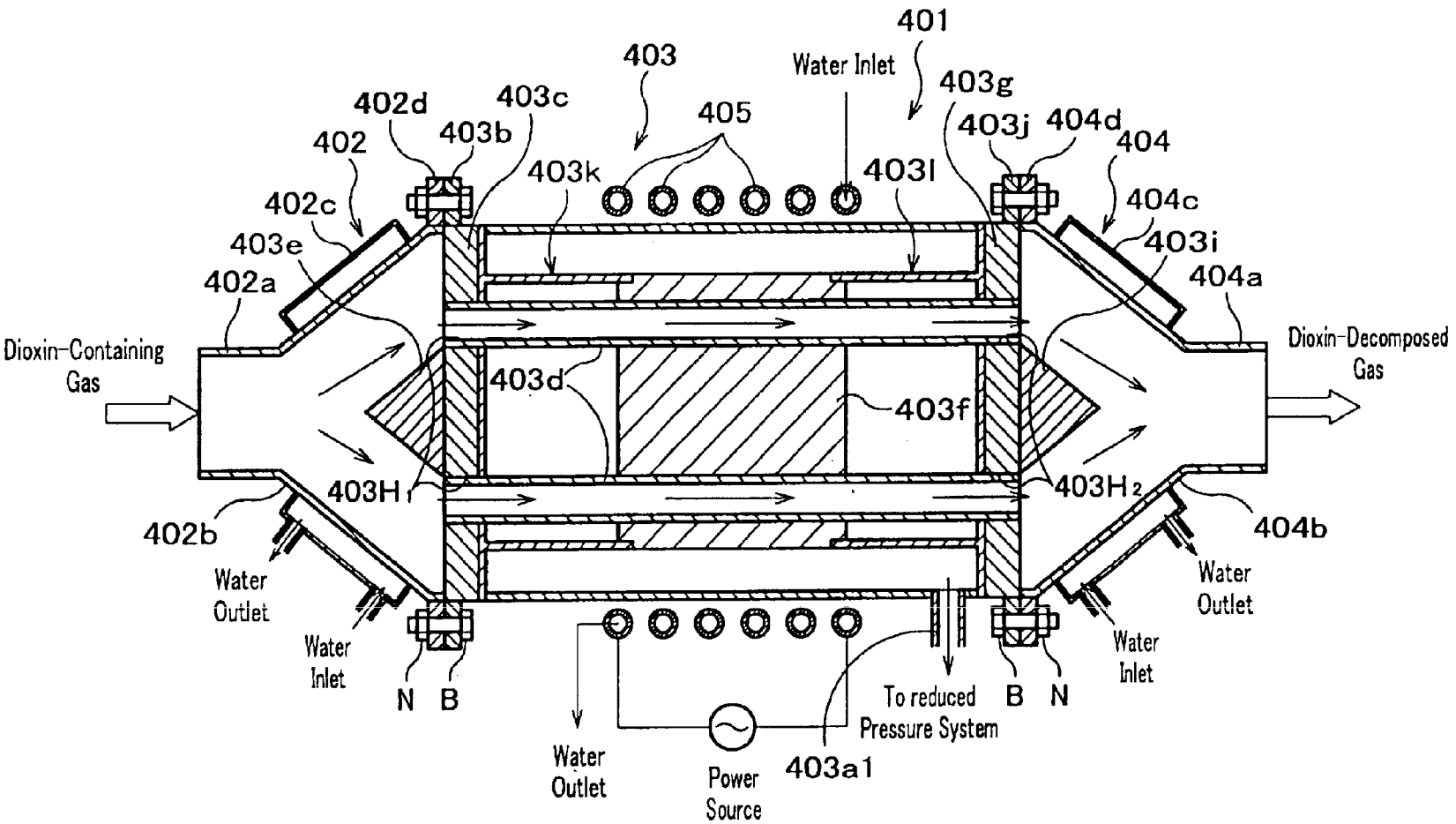
FIG. 20 is a longitudinal sectional view of FIG. 18.

The actions of this invention's organohalogen compound pyrolysis treatment device with the above arrangement shall now be described with reference to FIG. 20. With FIG. 20, part of the components shown in FIGS. 18 and 19 are illustrated in simplified form for ease of comprehension.

(1) Cooling water is made to flow through and power is supplied to induction heating coil 405 to heat the heating unit 403*a f* housed inside pyrolysis part 403.

(2) Heating unit 403*a f* is heated, the heat of heating unit 403*a f* is heat transferred to ceramic pipes 403*d*, and in a few seconds, ceramic pipes 403*d* are raised in temperature to a predetermined temperature, for example, 1400° C.

(3) The dioxin-containing gas is introduced into duct 402*b* via introduction entrance 402*a* of introduction part 402.

(4) The dioxin-containing gas that has been introduced receives a shear force due to the conical guide member 403*e* provided inside duct 402*b*, is thereby accelerated along the slope of the cone, and is distributed and guided into the eight ceramic pipes 403*d*, which are inserted respectively in the eight through holes 403$H_1$ of the cylindrical heating unit 403*a f* and have the ends at both sides fixed by pipe supporting plates 403*c* and 403*g*.

(5) The dioxin-containing gas that has been introduced into the respective ceramic pipes 403*d* is pyrolyzed favorably by contact with the inner wall surfaces of the ceramic pipes 403*d* that have been heated to 1400° C.

(6) The pyrolyzed gas is discharged to discharge part 404. In this process, the pyrolysis gas is discharged favorably from inside the eight ceramic pipes 403*d* to discharge port 404*a* by means of the guide member 403*i* provided inside duct 404*b* of discharge part 404.

(7) The dioxin pyrolysis gas that is discharged from discharge port 404*a* is treated at a downstream stage by a gas cleaning equipment for elimination of halogen gas, $NO_x$, etc. and is discharged to the atmosphere upon elimination of components that are harmful to the human body.

For example, a wet type alkali cleaning equipment or a dry type adsorption device may be used as the above mentioned gas cleaning equipment.

Though the above-described guide members 403*e* and 403*i* had conical shapes in the present embodiment, other embodiments shall now be described with reference to FIG. 21.

Figure 21A:
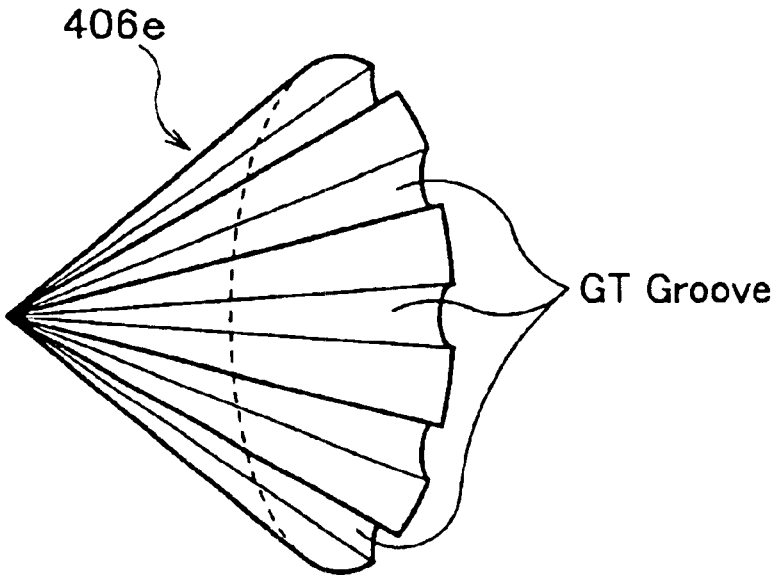
FIG. 21 shows diagrams of other embodiments of a guide member, related to this invention, for distributing and introducing exhaust gas, containing organohalogen compounds, to ceramic pipes, with FIG. 21A being a perspective view, showing a guide member of a first other embodiment wherein grooves are provided along the slope of a cone and FIG. 21B being a perspective view, showing a guide member of a second other embodiment having a dome-like protrusion.

Guide member 406*e* of a first other embodiment has a plurality of grooves GT provided along the slope of the cone from the apex of the cone as shown in FIG. 21A in order to further facilitate the introduction of the dioxin-containing gas into the interiors of the ceramic pipes in comparison to a conical guide member. Each grooves GT is preferably provided with a shape such that the width of groove GT expands from the apex of the cone towards the bottom side of the cone.

By thus providing such a gas guide member 406*e*, provided with a plurality of grooves GT along the slope of a cone, inside the duct of the introduction part, the cross-sectional area of the flow path of the gas inside the duct is made gradually smaller towards the downstream side and pressure energy is thus converted to the speed energy of the gas. And by the pushing of the gas into the ceramic pipes along the grooves GT, the gas can be distributed favorably and the gas can be made to flow through the ceramic pipes at a high gas flow rate.

Figure 21B:
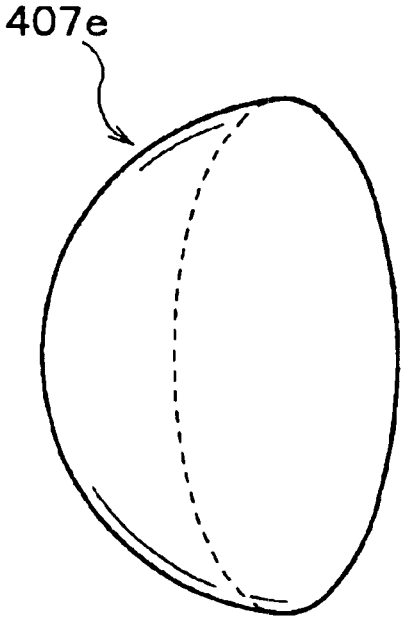

A dome-shaped protrusion may be provided as with guide member 407*e* of a second other embodiment, shown in FIG. 21B. The protrusion may for example have the shape of a 2:1 ellipse mirror plate or dish, etc.

By forming guide member 407*e* in this manner, the dioxin-containing gas can be introduced more readily into the interiors of the ceramic pipes.

EXAMPLES

A method of treating organohalogen compounds and/or substances containing organohalogen compounds, in other words, PCBs and/or PCBs-containing substances using this invention's organohalogen compound decomposition treatment device 1 shall now be described with reference to FIG. 3 or 4 as suited.

A capacitor containing PCBs is housed inside heating container 12. This heating container 12 is carried into lower chamber 10 from the carry-in entrance 15 that is provided at lower chamber 10 of gasifying means 2 and is set on the alumina pedestal 18 on lift 17 inside lower chamber 10 (see FIG. 4).

After closing the above mentioned carry-in entrance 15, valve 22 at the downstream side of vacuum exhaust pipe 20 is opened, the interior of lower chamber 10 is decompressed by means of vacuum pump 42, and the pressure inside lower chamber 10 is thereby made 100 Pa (gauge pressure) or less (see FIG. 3).

Thereafter, valve 22 is closed, valve 23, which is interposed between a nitrogen gas cylinder and inert gas introduction pipe 21, is opened to introduce nitrogen gas into lower chamber 10, and after nitrogen replacement has been accomplished, valve 23 is closed. This series of pressure reduction—nitrogen replacement operations is repeated twice.

After completion of the nitrogen replacement of the interior of lower chamber 10, shutter 14 is opened to put upper chamber 11, which is constantly maintained in a reduced pressure state by means of vacuum pump 42, and lower chamber 10, which has been subject to nitrogen replacement, into communication. Lift 17 is then raised to send out the heating container 12, in which the treated object P is contained, and make the container be housed in the inner side of high-frequency coil 24 provided inside upper chamber 11. Lift 17 is then made to contact the roof surface of lower chamber 10 to thereby seal the interior of upper chamber 11 (see FIG. 4).

Vacuum valve 46 and butterfly valve 45 are closed and liquid nitrogen is made to flow through cooling pipe 48 to actuate the pressure differential generating means 5. The pressure of the isolated space that has been closed by butterfly valve 45 and vacuum valve 46 is made lower than the pressure of the non-isolated space that is not closed to thereby generate a negative pressure state inside the closed, isolated space. Thereafter, butterfly valve 45 is opened gradually and the pressure inside upper chamber 11 of the above-described gasifying means 2 is set to 100 Pa (gauge pressure).

At the same time, heating unit 30 of pyrolysis means 3 is heated and stabilized in temperature at 1400° C. Since in this process the temperature rises due to heating and the pressure inside the space from the above-described gasifying means 2 to the above mentioned butterfly valve 45 increases, the opening of butterfly valve 45 is increased accordingly to adjust the pressure (see FIG. 3).

When the temperature of heating unit 30 of pyrolysis means 3 stabilizes at 1400° C., the high-frequency power supply of gasifying means 2 is turned on to gradually heat the heating container 12 to thereby heat and melt the treated object P and gasify the PCBs. In this process, the PCBs are gasified while adjusting the opening of butterfly valve 45 so that the pressure inside upper chamber 11 of the PCBs gasifying means 2 is maintained at 100 Pa (gauge pressure).

When upon complete vaporization of the PCBs, the pressure inside upper chamber 11 begins to drop with the opening of butterfly valve 45 being kept fixed, the high-frequency power supply of vaporization means 2 is turned off and heating container 12 is allowed to cool naturally. The power supply of pyrolysis means 3 is also turned off and heating unit 30 is also allowed to cool.

After completion of cooling of heating container 12, lift 17 is lowered and heating container 12 is moved to lower chamber 10 of gasifying means 2. Thereafter, shutter 14 is closed to partition upper chamber 11 and lower chamber 10 and the interior of upper chamber 11 is maintained in a reduced pressure state constantly.

Valve 23 is opened and after the interior of lower chamber 10 is brought to atmospheric pressure, heating container 12 is carried out from carry-in entrance 15 and the residues inside heating container 12 are taken out, thereby completing the decomposition treatment of PCBs and/or PCBs-containing substances.

The respective means of this invention's organohalogen compound decomposition treatment device 1 are arranged in blocks and connected via piping.

Since the device can thus be separated into the respective blocks for transport, the device can be transported readily and the installation of the device is also simplified.

Furthermore, an optimal device arrangement can be configured according to the type of treated object by the realignment of the various parts mentioned above, the addition of parts, etc. The configuration of organohalogen compound decomposition treatment device 1 is thus not limited to the above-described arrangements and sequences and may be determined as suited.

Also, the iron chloride that is recovered by the use of this invention's method or device may be used as industrial raw material and the sodium chloride and carbon powder that are recovered are harmless and may thus be used as snow melting agents, etc. Furthermore, since the residue inside the heating container does not contain any organohalogen compounds and other hazardous materials whatsoever, it can be recovered as slag and used in roadbed materials, blocks, etc.

The results of experiment using this invention's gaseous organohalogen compound decomposition treatment device 201 shall now be described.

For the experiment, oil samples of three levels (Sample 1: only electrical insulation oil; Sample 2: electrical insulation oil containing 10 mass % of liquid PCBs; Sample 3: only liquid PCBs) were used.

Here the gasification of each sample was performed inside a chamber adjusted in pressure to 100 Pa or less by the operation of a vacuum pump and performing high-frequency induction heating of a stainless steel container in which each sample was placed.

The decomposition treatment inside the decomposition treatment device was carried out by heating a stainless steel decomposition part to 1000° C. by high-frequency induction heating.

Whether or not the PCBs were decomposed was judged by interposing a dry trap between gaseous organohalogen compound decomposition treatment device 201 and the vacuum pump and using a gas chromatography device to detect whether or not PCBs and dioxins are contained in the activated carbon, which is the filler in the dry trap.

As a result, whereas 0.2 ppm of PCBs were detected with Sample 3 as shown in Table 1 below, most of the PCBs were decomposed. Also with Sample 2, all of the PCBs were decomposed.

TABLE 1

| Name of sample | PCBs content (%) | Material of decomposition part | Content of PCBs in activated carbon |
|---|---|---|---|
| Sample 1 | 0 | Stainless steel | Not detected |
| Sample 2 | 10 | Stainless steel | Not detected |
| Sample 3 | 100 | Stainless steel | 0.2 ppm |

It was thus confirmed that this invention's organohalogen compound decomposition device can decompose and render harmless PCBs that have been supplied in a gaseous state substantially without fail.

Examples of application of this invention's organohalogen compound pyrolysis treatment device to the treatment of dioxin-containing gas shall now be described with reference to Table 1.

1. Experimental Conditions (a) High-frequency power supply: 50 kW, 200 V×3Φ, frequency f=10 kHz (b) Size of pyrolysis treatment device: 465L×170W×170H (c) Analyzing device: High-resolution gas chromatography, high-resolution mass spectrometer 2. Experimental Methods (1) The power of the high-frequency power supply is supplied to an induction heating coil. In this process, cooling water is made to flow through the interior of the coil.

(2) Heating is performed until the central temperature of the heating unit inside the pyrolysis part becomes 1400° C.

(3) 100 mg of dioxin and 50 g of vinyl chloride are placed inside a stainless steel container and heated under air, and the vaporized dioxin-containing gas is supplied to the introduction part of the pyrolysis device.

(4) The dioxin-containing gas that has been distributed favorably by the guide member inside the introduction part is pyrolyzed by contact with the inner walls of the ceramic pipes that have been heated to 1400° C.

Though as the thermal decomposition temperature of dioxin, there is the (1) low thermal decomposition temperature of 800 to 100° C. (only the chlorine is removed but the benzene ring is not decomposed in this case) and (2) high thermal decomposition temperature of approximately 1400° C. (the chlorine is removed and the benzene ring is decomposed), the data for pyrolysis at a temperature of 1400° C. are shown for the present example (see Table 2).

(5) The pyrolysis gas that is discharged from the pyrolysis part to the discharge part is collected to the discharge part by the guide member and is discharged from the discharge port.

TABLE 2

Results of Analysis of Exhaust Gas from the Pyrolysis Treatment Device
Thermal decomposition temperature: 1400° C.

| Item of analysis | | Measured value | Toxicity equivalent (TEQ) | |
|---|---|---|---|---|
| Dioxins | 2,3,7,8-$T_4$CDD | N.D | x1 | 0 |
| | 1,2,3,7,8-$T_5$CDD | N.D | x1 | 0 |
| | 1,2,3,4,7,8-$T_6$CDD | N.D | x0.1 | 0 |
| | 1,2,3,6,7,8-$T_6$CDD | N.D | x0.1 | 0 |

TABLE 2-continued

Results of Analysis of Exhaust Gas from the Pyrolysis Treatment Device
Thermal decomposition temperature: 1400° C.

| Item of analysis | | Measured value | Toxicity equivalent (TEQ) | |
|---|---|---|---|---|
| | 1,2,3,7,8,9-$T_6$CDD | N.D | x0.1 | 0 |
| | 1,2,3,4,6,7,8-$T_7$ CDD | N.D | x0.01 | 0 |
| | $0_8$CDD | N.D | x0.0001 | 0 |
| | Total of $PCDD_S$ | — | | 0 |
| Dibenzofurans | 2,3,7,8-$T_4$CDF | N.D | x0.1 | 0 |
| | 1,2,3,7,8-$T_5$CDF | N.D | x0.05 | 0 |
| | 2,3,4,7,8-$T_5$CDF | N.D | x0.5 | 0 |
| | 1,2,3,4,7,8-$T_6$CDF | N.D | x0.1 | 0 |
| | 1,2,3,6,7,8-$T_6$CDF | N.D | x0.1 | 0 |
| | 1,2,3,7,8,9-$T_6$CDF | N.D | x0.1 | 0 |
| | 2,3,4,6,7,8-$T_6$CDF | N.D | x0.1 | 0 |
| | 1,2,3,4,6,7,8-$T_7$ CDF | N.D | x0.01 | 0 |
| | 1,2,3,4,7,8,9-$T_7$ CDF | N.D | x0.01 | 0 |
| | $0_8$CDF | N.D | x0.0001 | 0 |
| | Total of $PCDF_S$ | — | | 0 |
| | Total of ($PCDD_S$ + $PCDF_S$) | — | | 0 |
| Coplanar PCBs Non-ortho | 3,4,4',5-$H_4$CB (#81) | N.D | x0.0001 | 0 |
| | 3,3,4,4'-$H_4$CB (#77) | 0.1 | x0.0001 | 0.00001 |
| | 3,3',4,4',5-$H_5$CB (#126) | N.D | x0.1 | 0 |
| | 3,3',4,4',5,5'-$H_6$CB (#169) | N.D | x0.01 | 0 |
| Mono-ortho | 2',3,4,4',5-$H_5$CB (#123) | N.D | x0.0001 | 0 |
| | 3,3'4,4',5-$H_5$CB (#118) | 0.8 | x0.0001 | 0.00008 |
| | 2,3,4,4',5-$H_5$CB (#114) | N.D | x0.0005 | 0 |
| | 2,3,3'4,4'-$H_5$CB (#105) | 0.4 | x0.0001 | 0.00004 |
| | 2,3'4,4',5,5'-$H_6$CB (#167) | N.D | x0.00001 | 0 |
| | 2,3,3'4,4',5-$H_6$CB (#156) | N.D | x0.0005 | 0 |
| | 2,3,3'4,4',5'-$H_6$CB (#157) | N.D | x0.0005 | 0 |
| | 2,3,3'4,4',5,5'-$H_7$CB (#189) | N.D | x0.0001 | 0 |
| Total of $C_0$-PCB | | — | | 0.00013 |
| Total of ($PCDD_S$ + $PCDF_S$ + Co-$PCB_S$) | | — | | 0.00013 |

(Note) Toxicity equivalent (TEQ): Indicates the toxicity relative to 2,3,7,8-TCDD (tetrachlorodibenzo-para-dioxin), which is strongest in toxicity among dioxins.

TABLE 3

Explanation of the Items of Table 2

| Item of analysis | | Lower limit of quantification (ng) |
|---|---|---|
| Dioxins | Tetrachlorinated compounds | 0.05 |
| | Pentachlorinated compounds | 0.05 |
| | Hexachlorinated compounds | 0.1 |
| | Heptachlorinated compounds | 0.1 |
| | Octachlorinated compounds | 0.2 |

TABLE 3-continued

Explanation of the Items of Table 2

| Item of analysis | | Lower limit of quantification (ng) |
|---|---|---|
| Dibenzofurans | Tetrachlorinated compounds | 0.05 |
| | Pentachlorinated compounds | 0.05 |
| | Hexachlorinated compounds | 0.1 |
| | Heptachlorinated compounds | 0.1 |
| | Octachlorinated compounds | 0.2 |
| Coplanar PCBs | Non-ortho | 0.1 |
| | Mono-ortho | 0.1 |

Note 1. Measured value in Table 1: amount (ng) of dioxins in the sample.

2. Toxicity equivalent: Toxicity equivalent (ng-TEQ) relative to 2,3,7,8-$T_4$CDD; calculated with the measured concentration below the lower limit of quantification being set to [0].

3. WHO (1998) was referred to for the toxicity equivalent factors.

4. N.D.: Less than the lower limit of quantification. The lower limits of quantification are as indicated above.

As can be understood from Table 2, the measured values of dioxins, dibenzofurans, and coplanar PCBs are values that adequately satisfy the environmental standards at the exit of the pyrolysis device.

Also, with the exception of three types of organochlorine compounds among the coplanar PCBs, all compounds among dioxins, dibenzofurans, and coplanar PCBs were of concentrations less than or equal to the detection limit (quantification limit).

The toxicity equivalent (TEQ) in Table 2 is the toxicity relative to 2,3,7,8-TCDD (tetrachlorodibenzo-para-dioxin), which is strongest in toxicity among dioxins. Also, the constants indicated at the left side in the toxicity equivalent (TEQ) column in Table 2 are toxicity equivalent factors and each indicates the toxicity when the toxicity of 2,3,7,8-TCDD (tetrachlorodibenzo-para-dioxin), which is the most toxic, is set to 1.

What is claimed is:

1. A high-frequency induction heating device comprising:

an introduction part which introduces a gas to be treated, a pyrolysis part which pyrolyzes the gas to be treated, an induction heating coil provided around the outer circumference of said pyrolysis part so as to surround and heat said pyrolysis part, and an exhaust part which exhausts the gas having been decomposed in said pyrolysis part;

said pyrolysis part comprising a cylindrical body both ends of which are sealed, slits which communicate the interior with the exterior of said cylindrical body provided on the outer surface of said cylindrical body, and a communication pores to be communicated with an introduction tube which introduces said gas to be treated into the interior of said cylindrical body.

2. The high-frequency induction heating device as claimed in claim 1, wherein said cylindrical body is provided so that the cross-section of the passage of said cylindrical body becomes smaller from the upstream towards the downstream.

3. A high-frequency induction heating device comprising:

an introduction part which introduces a gas to be treated, a pyrolysis part which pyrolyzes the gas to be treated, an induction heating coil provided around the outer circumference of said pyrolysis part so as to surround and heat said pyrolysis part, and an exhaust part which exhausts the gas having been decomposed in said pyrolysis part;

said pyrolysis part comprising a cylindrical body which introduces the gas provided so that the cross-section of the passage of said cylindrical body becomes smaller from the upstream towards the downstream.

4. A high-frequency induction heating device comprising:

an introduction part which introduces a gas to be treated, a pyrolysis part which pyrolyzes the gas to be treated, an induction heating coil provided around the outer circumference of said pyrolysis part so as to surround and heat said pyrolysis part, and an exhaust part which exhausts the gas having been decomposed in said pyrolysis part;

said pyrolysis part having a heating element having a plurality of through holes along the inside of the outer circumference of the diameter direction thereof and ceramic pipes inserted within said plurality of through holes and supported by pipe supporting plates accommodated therein.

5. The high-frequency induction heating device as claimed in claim 4, wherein said pyrolysis part has pressure reducing means for reducing the pressure of the body.

6. The high-frequency induction heating device as claimed in claim 4, wherein said pyrolysis part has compressing means for compressing the body by an inert gas.

7. The high-frequency induction heating device as claimed in claim 4, wherein said pipe supporting plate has a guide member for introducing a gas to be treated into said ceramic pipe.

8. The high-frequency induction heating device as claimed in claim 7, wherein said ceramic pipe is made of at least one member selected from the group consisting of silicon carbide and alumina.

9. The high-frequency induction heating device as claimed in claim 8, wherein step part to be fit to spacers are provided on both ends of said heating element.

10. The high-frequency induction heating device as claimed in claim 9, wherein said spacer comprises non-dielectric material and is formed from a flange having the plurality of through holes and cylindrical body.

* * * * *